US008430049B1

(12) United States Patent
Tureaud et al.

(10) Patent No.: US 8,430,049 B1
(45) Date of Patent: Apr. 30, 2013

(54) LAUNCH AND RECOVERY SYSTEMS AND METHODS

(75) Inventors: Thomas F. Tureaud, Fairfax, VA (US); Douglas E. Humphreys, Great Falls, VA (US)

(73) Assignee: Vehicle Control Technologies, Inc., Reston, VA (US)

( * ) Notice: Subject to any disclaimer, the term of this patent is extended or adjusted under 35 U.S.C. 154(b) by 727 days.

(21) Appl. No.: 12/460,048

(22) Filed: Jul. 13, 2009

(51) Int. Cl.
*B63B 35/40* (2006.01)

(52) U.S. Cl.
USPC ..... 114/259; 114/258; 114/366; 414/137.7

(58) Field of Classification Search ..... 114/242, 114/244, 249, 258, 259, 366, 373, 375; 414/137.7
See application file for complete search history.

(56) References Cited

U.S. PATENT DOCUMENTS

| | | | | |
|---|---|---|---|---|
| 3,466,798 | A | 9/1969 | Speers et al. | |
| D217,744 | S | 6/1970 | Peterson et al. | |
| 3,536,023 | A * | 10/1970 | Bascom et al. | 114/259 |
| 3,647,253 | A | 3/1972 | Hettinger et al. | |
| 3,650,234 | A | 3/1972 | Goudy | |
| 3,734,321 | A | 5/1973 | Long et al. | |
| 3,993,011 | A * | 11/1976 | Garland | 414/137.7 |
| D242,615 | S | 12/1976 | Henning | |
| 4,391,423 | A | 7/1983 | Pruett et al. | |
| D290,108 | S | 6/1987 | Wolfe | |
| D291,299 | S | 8/1987 | Hawkes | |
| 4,705,331 | A | 11/1987 | Britton | |
| D304,923 | S | 12/1989 | Pado | |
| D308,851 | S | 6/1990 | Templeman | |
| 5,048,449 | A | 9/1991 | Templeman | |
| D323,808 | S | 2/1992 | DeSantis | |
| 5,120,099 | A | 6/1992 | Fletcher | |
| D328,732 | S | 8/1992 | Whitley, II | |
| 5,138,966 | A | 8/1992 | Whitley, II | |
| 5,158,034 | A | 10/1992 | Hsu | |
| D331,738 | S | 12/1992 | Simpson | |
| 5,307,754 | A | 5/1994 | Leonardis | |
| D350,326 | S | 9/1994 | Grifflin | |
| D352,023 | S | 11/1994 | Corn | |
| 5,396,860 | A | 3/1995 | Cheng | |
| D363,914 | S | 11/1995 | Corn | |
| D371,411 | S | 7/1996 | Albritton | |
| 5,568,783 | A | 10/1996 | Ditchfield | |

(Continued)

OTHER PUBLICATIONS

Vehicle Control Technologies, Inc., "STTR Proposal No. N08A-016-0269—Expendable Glider for Oceanographic Research", Mar. 18, 2008, pp. 3-25, see specifically p. 20.

(Continued)

*Primary Examiner* — Lars A Olson
(74) *Attorney, Agent, or Firm* — Womble Carlyle Sandridge & Rice, LLP

(57) ABSTRACT

An apparatus for launching and recovering at least one water vehicle includes a frame supported by a base. The base may be mounted to the deck of a boat. The frame includes an elongate stand for supporting the water vehicle. The frame is mounted for being moved relative to the base between a stowed position and a deployed position, so that a rear end of the stand is at a lower elevation in the deployed position than in the stowed position. A guide is carried by the frame and adapted for being moved back and forth along the stand. The guide is for mechanically guiding the water vehicle along the stand.

39 Claims, 27 Drawing Sheets

U.S. PATENT DOCUMENTS

| | | | |
|---|---|---|---|
| 5,655,939 | A | 8/1997 | Garrido Salvadores |
| 5,686,694 | A | 11/1997 | Hillenbrand et al. |
| 5,704,817 | A | 1/1998 | Vaughn |
| D390,618 | S | 2/1998 | Wilson |
| 5,713,293 | A | 2/1998 | Shiffler et al. |
| D394,633 | S | 5/1998 | Gauthier et al. |
| 5,786,545 | A | 7/1998 | Hillenbrand |
| D400,624 | S | 11/1998 | Hornsby et al. |
| 5,970,546 | A | 10/1999 | Danis |
| D440,619 | S | 4/2001 | Chiang |
| 6,359,834 | B1 | 3/2002 | English |
| 6,390,012 | B1 | 5/2002 | Watt et al. |
| 6,390,761 | B1 | 5/2002 | Palmer, Jr. et al. |
| 6,419,292 | B1 | 7/2002 | Calcote et al. |
| D466,175 | S | 11/2002 | Katz et al. |
| 6,558,104 | B1 | 5/2003 | Vlaanderen et al. |
| 6,600,695 | B1 | 7/2003 | Nugent et al. |
| 6,641,353 | B2 | 11/2003 | Oliver |
| D487,245 | S | 3/2004 | Geriene et al. |
| 6,738,314 | B1 | 5/2004 | Teeter et al. |
| D492,242 | S | 6/2004 | Geriene et al. |
| 6,766,745 | B1 | 7/2004 | Kuklinski et al. |
| 6,779,475 | B1 | 8/2004 | Crane et al. |
| 6,854,410 | B1 | 2/2005 | King et al. |
| D505,104 | S | 5/2005 | Osumi et al. |
| 6,969,030 | B1 | 11/2005 | Jones et al. |
| 7,000,560 | B2 | 2/2006 | Wingett et al. |
| 7,010,401 | B1 | 3/2006 | Richburg et al. |
| 7,021,231 | B2 | 4/2006 | Smart |
| 7,051,664 | B2 | 5/2006 | Robichaud et al. |
| 7,104,505 | B2 | 9/2006 | Tchoryk et al. |
| D533,497 | S | 12/2006 | Templeman |
| 7,156,036 | B2 | 1/2007 | Seiple |
| D537,142 | S | 2/2007 | Eagan |
| D549,297 | S | 8/2007 | Eagan |
| D560,264 | S | 1/2008 | Nakpodia |
| 7,377,592 | B2 | 5/2008 | Kraenzle |
| D573,220 | S | 7/2008 | Nakpodia |
| D573,935 | S | 7/2008 | Tureaud et al. |
| D573,937 | S | 7/2008 | Tureaud et al. |
| D578,463 | S | 10/2008 | Tureaud et al. |
| D580,341 | S | 11/2008 | Tureaud et al. |
| 7,775,174 | B1 | 8/2010 | Humphreys et al. |
| D630,994 | S | 1/2011 | Tureaud et al. |
| D650,319 | S | 12/2011 | Tureaud et al. |
| 8,145,369 | B1 | 3/2012 | Tureaud et al. |
| 2001/0025594 | A1 | 10/2001 | Daniels |
| 2002/0152945 | A1 | 10/2002 | Geriene et al. |
| 2002/0164239 | A1 | 11/2002 | Angermeier |

OTHER PUBLICATIONS

Bondaryk et al. (presumably), "Automated Launch and Recovery of UUVs and Towed Assets from USSV", date is before Nov. 1, 2007, pp. 1-5/Frames 1-20, Brooke Ocean Technology Ltd.

U.S. Appl. No. 11/982,041, filed Nov. 1, 2007; In re: Thomas F. Tureaud et al., entitled "Docking Apparatuses and Methods".

U.S. Appl. No. 29/315,638, filed Jul. 13, 2009; In re: Thomas F. Tureaud et al., entitled Apparatus for Mechanically Guiding a Water Vehicle That is Bein.

Harken, "Installation Sheet—CRX Roller Traveler: 3074, 3075, 3080, 3084, 3085", May 2007, pp. 1-2.

Harken, "Installation Sheet—CB Traveler Cars", Mar. 2007, pp. 1-2.

U.S. Appl. No. 13/402,549, filed Feb. 22, 2012.

Notice of Allowance dated Sep. 26, 2012 in U.S. Appl. No. 13/402,549.

* cited by examiner

LAUNCH AND RECOVERY SYSTEMS AND METHODS

STATEMENT OF GOVERNMENT SUPPORT

The present invention was made with Government support under STTR Program Contract No. N07-037 awarded by the United States Navy. The Government has certain rights in the invention.

TECHNICAL FIELD

This disclosure generally relates to launching and recovering a water vehicle, and it more specifically relates to launching water vehicles from, and recovering water vehicles to, a boat.

BACKGROUND OF THIS DISCLOSURE

Launching a water vehicle from, and recovering a water vehicle to, the deck of a boat may present numerous challenges, such as when the vehicle being launched or recovered is heavy and/or in difficult sea states (e.g., high wind, heave and/or surge conditions). Accordingly, there is a desire for launch and recovery systems and methods that provide a new balance of properties.

SUMMARY OF SOME ASPECTS OF THIS DISCLOSURE

In accordance with one aspect of this disclosure, an apparatus for launching and recovering at least one water vehicle includes a frame supported by a base. The base may be mounted to the deck of a boat. The frame includes an elongate stand that may be used for supporting the water vehicle above the deck of the boat. The frame is mounted for being moved relative to the base between a stowed position and a deployed position, so that a rear end of the stand is at a lower elevation in the deployed position than in the stowed position. A guide is carried by the frame and adapted for being moved back and forth along the stand, for mechanically guiding the water vehicle along the stand.

The apparatus typically includes a winch for reeling in and unreeling a flexible tensile member (e.g., tow line) that is attached to the water vehicle. A first length of the tow line may be more rigid than a second length of the tow line. The guide may comprise a tapered guide passageway through which the flexible tensile member extends so that the relatively rigid first length is positioned between the water vehicle and the second length. The relatively rigid first length and the guide passageway may be cooperative for mechanically guiding the water vehicle along the stand in the longitudinal direction.

The guide may comprise a guide vehicle for mechanically guiding (e.g., carrying) the water vehicle along the stand in the longitudinal direction. The apparatus may further include a latch for automatically releasably securing the guide vehicle at the rear end of the stand.

In accordance with one aspect of this disclosure, an apparatus for launching and recovering water vehicles includes a rack supported by a base. The base may be mounted to the deck of a boat. The rack includes a plurality of stands for respectively supporting the water vehicles. The rack is mounted for being moved relative to the base between a stowed position and a deployed position. For each stand, at least a rear end of the stand is at a lower elevation in the deployed position than in the stowed position.

An aspect of this disclosure is a method of at least recovering a water vehicle to a boat vehicle while the water vehicle is in a body of water and the boat is floating in the body of water. The method includes moving a stand on the boat from a stowed position to a deployed position, so that the stand is closer to the body of water in the deployed position than in the stowed position. Relative movement is caused between the water vehicle and the boat while the stand is in the deployed position, including causing the water vehicle and the boat to become closer to one another, causing the water vehicle to become proximate to the stand, and mechanically guiding the water vehicle along the stand so that the water vehicle is supported by the stand. The mechanical guiding may be provided by way of cooperation between a variety of features.

An aspect of this disclosure is a method of at least recovering first and second water vehicles from a body of water to a rack while the rack is supported by a boat floating in the body of water. The method includes substantially simultaneously placing the first and second water vehicles on the rack while the first water vehicle is adjacent to and latched to the second water vehicle, and supporting the first and second water vehicles on the rack while the first water vehicle is latched to the second water vehicle.

Other aspects and advantages of embodiments of this disclosure will become apparent from the following.

BRIEF DESCRIPTION OF THE DRAWINGS

Having described some aspects of this disclosure in general terms, reference will now be made to the accompanying drawings, which are not necessarily drawn to scale and many of which are at least somewhat schematic, and wherein.

DETAILED DESCRIPTION OF EMBODIMENTS OF THIS DISCLOSURE

Figure 1:
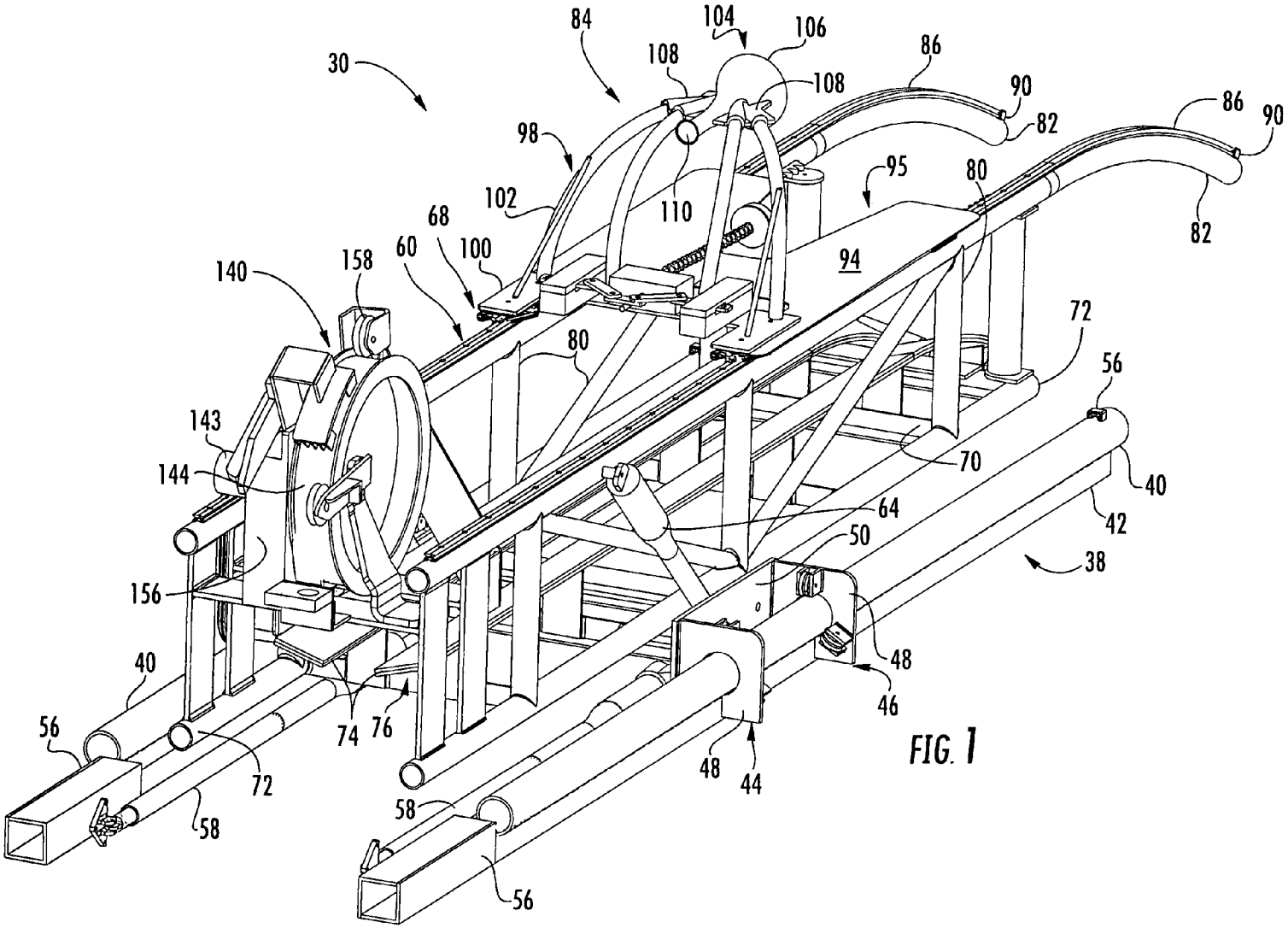
FIG. 1 is a front pictorial view of a launch and recovery system ("LARS") in isolation and in a rearward stowed position, in accordance with an exemplary embodiment of this disclosure.

Referring now in greater detail to the drawings, in which like numerals refer to like parts throughout the several views, a launch and recovery system ("LARS") 30 (FIGS. 1-5) is described in the following, in accordance with an exemplary embodiment of this disclosure. Very generally described and in accordance with one example of a method of operation that will be described in greater detail below, after a detailed discussion of the LARS 30 in isolation, the LARS may be carried on a boat 32 (which is schematically partially shown in FIGS. 14-28) and be used for launching and recovering one or more other water vehicles. The other water vehicles may include, but are not limited to, an unmanned, underwater tow-body (e.g., an intercepting vehicle 34 (FIGS. 14-28)) and an unmanned underwater vehicle (e.g., a self-propelled retrievable vehicle 36 (FIGS. 14-28)) that may be launched and recovered through the use of the intercepting vehicle. For example and not limitation, suitable examples of a boat 32, intercepting vehicle 34 (e.g., an unmanned underwater vehicle) and retrievable vehicle 36 (e.g., an unmanned underwater vehicle) are disclosed in U.S. patent application Ser. No. 11/982,041, which was filed on Nov. 1, 2007. The entire disclosure of U.S. patent application Ser. No. 11/982,041, which is filed on Nov. 1, 2007, is incorporated herein by reference.

FIGS. 1-5 respectively are front pictorial, rear pictorial, top plan, left elevation and rear elevation views of the LARS 30 in isolation and in a rearward stowed position. The LARS 30 includes a rigid base 38 that includes elongate, spaced apart, side-by-side base rails 40 that are substantially parallel to one another and extend in a longitudinal direction. Each of the base rails 40 may be a piece of metal pipe or any other suitable structure. Each of the base rails 40 is typically mounted to an upright base support 42 that serves to elevate the base rail. Each base support 42 may be an elongate, angular shaped piece of metal, or any other suitable structure.

A carriage 44 is movably mounted to the base 38 for being moved longitudinally along the base between rearward and forward positions. The carriage 44 includes subcarrages 46 that may be connected to one another by one or more cross bars. As best understood with reference to FIGS. 1 and 2, each subcarriage 46 includes end plates 48 that are mounted to a side plate 50. Each of the end plates 48 includes a downwardly open slot that extends completely through the end plate and downwardly from a hole that extends completely through the end plate. The base supports 42 and base rails 40 respectively extend through the slots and holes of the of the end plates 48.

Figure 6:
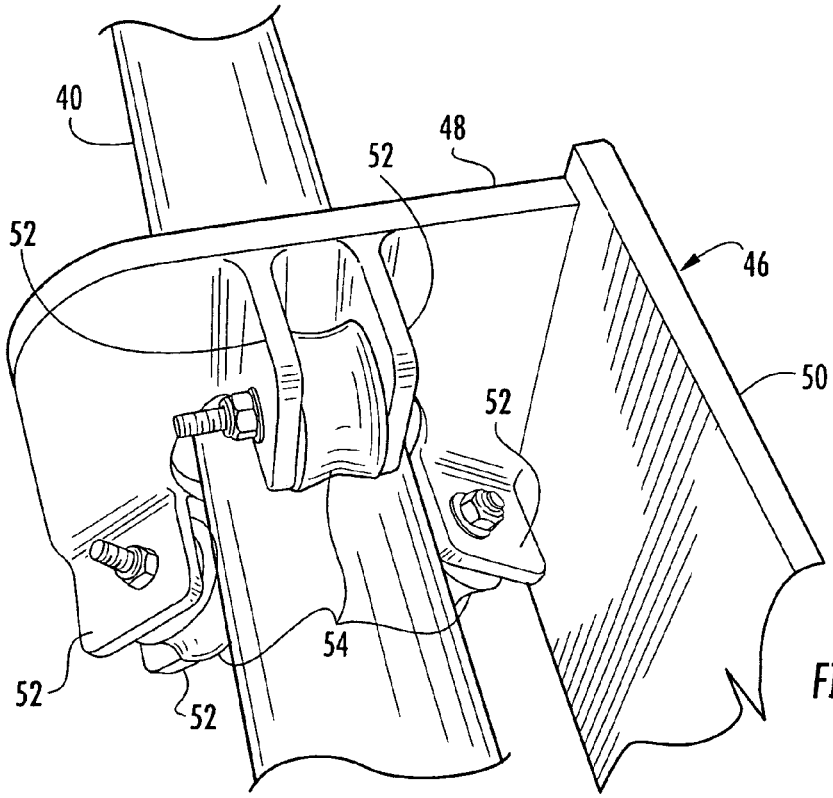
FIG. 6 is a pictorial view of a portion of a base and subcarriage of the LARS.

Referring to FIG. 6, for each of the end plates 48, a group of brackets 52 is fixedly mounted to the end plate and extends around the respective base rail 40. Each of the brackets 52 rotatably carries a transport roller 54 that is for rolling along the respective base rail 40. The transport rollers 54 support the carriage 44 and allow the carriage to be moved along the base 38.

The carriage 44 may be primarily made of metal pieces that are welded together or attached in any other suitable manner, except, for example, the transport rollers 54 may be made out of rigid (e.g., fiber-reinforced) polymer material or any other suitable material. As best understood with reference to FIGS. 1 and 2, end stops 56 are fixedly mounted to the base rails 40, or otherwise obstruct travel along the base rails, for keeping the subcarrages 46 from traveling off the ends of the base rails.

Any other suitable interface may be used between the base 38 and the carriage 44 for allowing the carriage to travel back and forth along the base. For example, the interface may be in the form of any suitable type of assemblies (e.g., wheeled assemblies) that respectively engage the base rails 40 and allow the carriage 44 to travel relative thereto, while keeping the carriage from becoming separated from the base rails. For example, the wheeled assemblies may be conventional and of the type employed by roller coasters, or the like.

Figure 3:
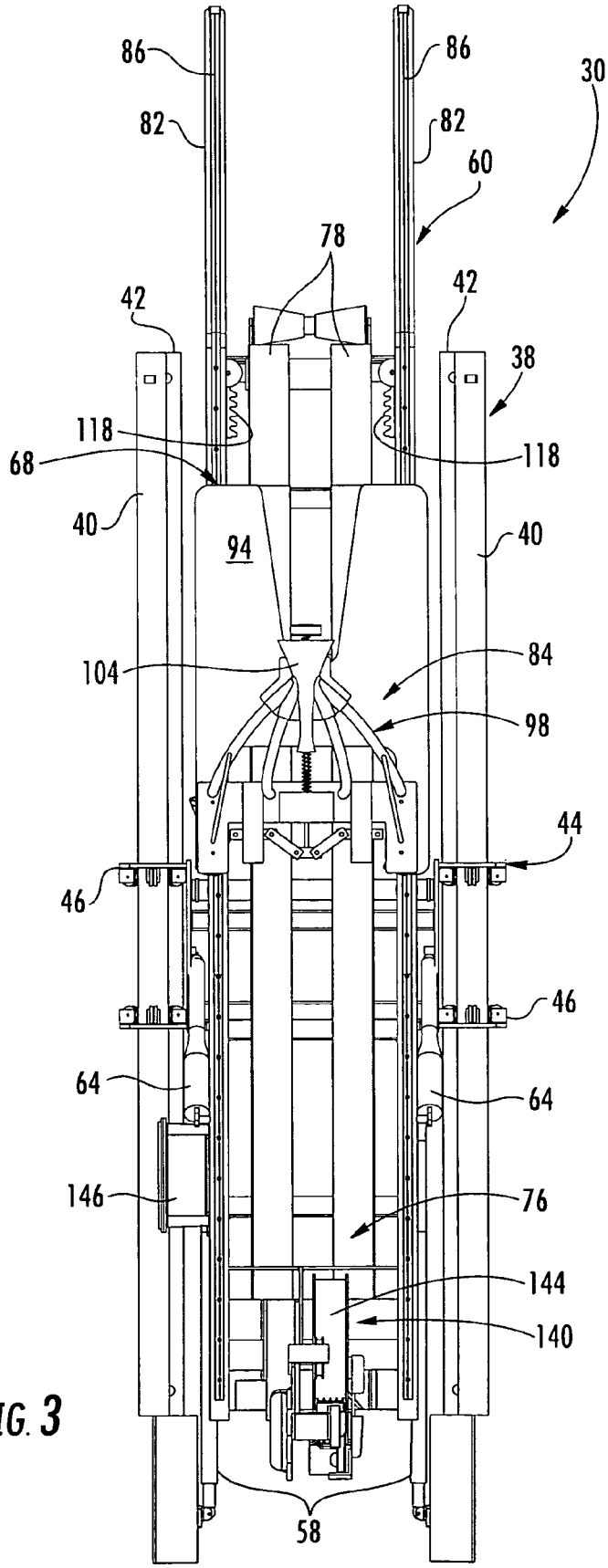
Figure 7:
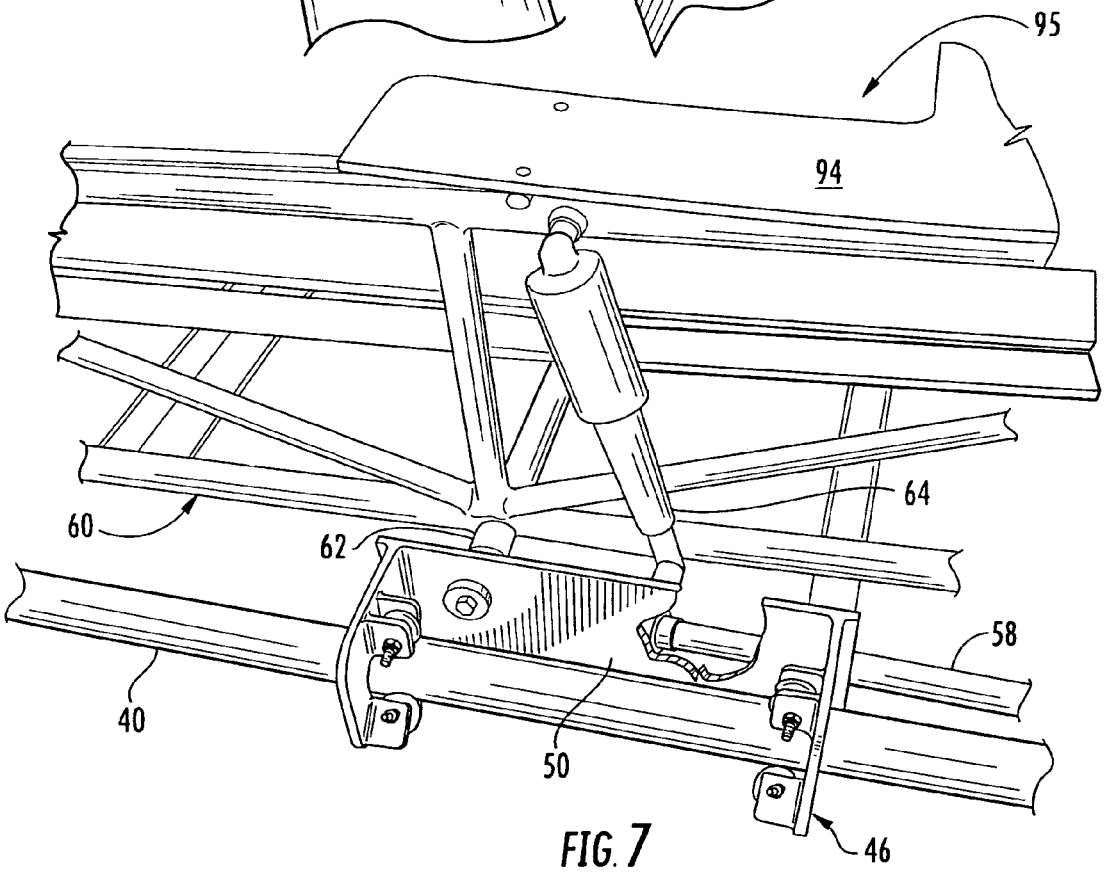
FIG. 7 is a pictorial view of a portion of the LARS, wherein a portion of the subcarriage is cut-away.

As best understood with reference to FIGS. 1, 3 and 7, one or more carriage actuators 58 are connected to the carriage 44 for moving the carriage along the base 38. For example, there may be two carriage actuators 58, with each having a front end fixedly connected to the base 38 (e.g., see FIG. 3) or the structure that the base is fixedly mounted to, and a rearward end fixedly connected to the respective carriage side plate 50. A portion of the side plate 50 is cut-away in FIG. 7 to show the rear end of the carriage actuator 58 that is fixedly mounted to the side plate. The carriage actuators 58 may be any suitable type of actuators, such as, but not limited to, screw actuators, pneumatic actuators or hydraulic actuators.

A rigid frame 60 is pivotably supported by the base 38, such as by each side of the frame being pivotably mounted to the adjacent side plate 50 by way of a pivotable connection 62 (e.g., pivot pin, axle or any other suitable device) that may be best seen in FIG. 7 as including a bushing between the respective side plate 50 and the frame. The frame 60 may be primarily made of metal pieces that are welded together or attached in any other suitable manner.

One or more frame actuators 64 are connected to the frame 60 for inclining the frame relative to the carriage 44 and base 38. For example, there may be two frame actuators 64 at opposite sides of the LARS 30. As best understood with reference to FIG. 7, each frame actuator 64 has a lower end pivotably connected to the respective side plate 50, and an upper end pivotably connected by to the frame 60. The frame actuators 64 may be any suitable type of actuators, such as, but not limited to, screw actuators, pneumatic actuators or hydraulic actuators.

Figure 4:
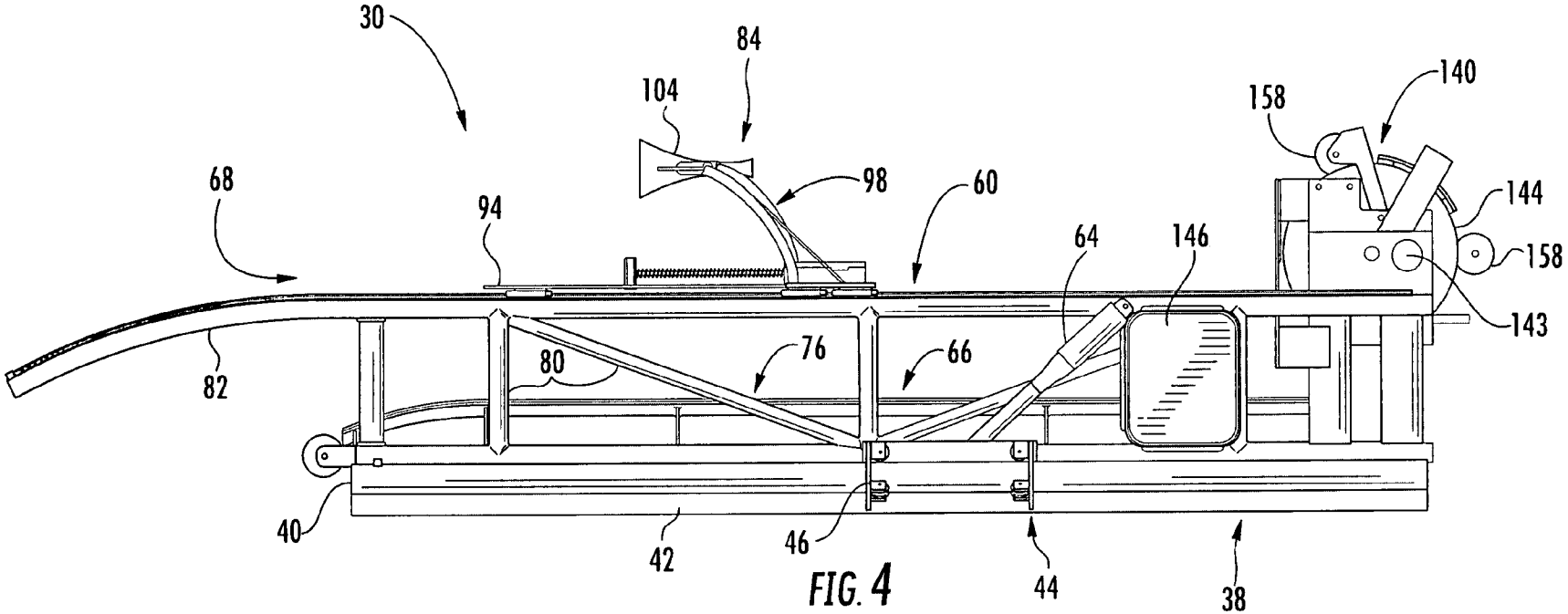

As best understood with reference to FIGS. 2, 4 and 5, the frame 60 may be characterized as being, including or defining a rack that includes an elongate lower stand 66 for mechanically guiding and supporting a lower water vehicle (e.g., the retrievable vehicle 36 (FIGS. 14-28)) and an elongate upper stand 68 for mechanically guiding and supporting an upper water vehicle (e.g., the intercepting vehicle 34 (FIGS. 14-28)), as will be discussed in greater detail below. Accordingly, the frame 60 may be referred to as a rack-like frame with a plurality of stands 66, 68. The lower stand 66 is positioned beneath the upper stand 68, and the stands are substantially parallel and adjacent to one another. In some applications, the lower stand 66 may be optional (e.g., may be omitted).

The frame 60/lower stand 66 includes laterally extending lower cross bars 70 (e.g., FIG. 13A) extending between and connected to longitudinal lower bars 72, upright supports 74 (e.g., FIG. 13A) that are respectively mounted to and extend upwardly from the cross bars 70, and a lower platform 76. The lower platform 76 typically is in the form of a pair of adjacent longitudinal support strips 78 that are respectively mounted to the upright supports 74. The support strips 78 are spaced apart and side-by-side with respect to one another. In the lateral direction, the support strips 78 are inclined downwardly toward one another. As best understood with reference to FIG. 4, in the longitudinal direction, the support strips 78 extend substantially straight, except for being curved downwardly at the rear end of the LARS 30.

The lower platform 76, more specifically the support strips 78, may be fabricated from low friction plastic boards, composite boards, or wooden boards (e.g., marine plywood) that optionally may be covered with a lower friction material (e.g., plastic material, carpeting, or any other suitable material) so that the lower water vehicle (e.g., the retrievable vehicle 36) may slide relative to and along the support strips, as will be discussed in greater detail below. For example, the support strips 78 may be constructed of materials used to make conventional boat trailer bunks. Alternatively, the support strips 78 may be replaced with a series of rollers or any other suitable devices for serving the function of the lower platform 76. That is, different types and configurations of platforms are within the scope of the present invention. For example, the lower stand 66 and/or lower platform 76 may be in the form of another type of device (e.g., "cradling" device) for receiving the lower water vehicle (e.g., the retrievable vehicle 36).

The frame 60/upper stand 68 includes upright bars 80 extending upwardly from the longitudinal bars 72 of the lower stand 66, and elongate, spaced apart, side-by-side, upper rails 82 that are mounted to the upright bars 80 and extend in the longitudinal direction. As best understood with reference to FIG. 4, in the longitudinal direction, the upper rails 82 extend substantially straight, except for being curved downwardly at the rear end of the LARS 30.

The upper stand 68 further includes a guide vehicle 84 (FIGS. 1-5) for mechanically guiding the intercepting vehicle 34, as will be discussed in greater detail below. Each of the upper rails 82 may be a piece of metal pipe, or any other suitable structure for having the guide vehicle 84 travel therealong. Any suitable interface may be used between the upper rails 82 and the guide vehicle 84 for allowing the guide vehicle to travel back and forth along the upper rails. For example, the interface may be in the form of wheeled assemblies (not shown) that respectively engage the upper rails 82 and allow the guide vehicle 84 to travel relative thereto, while keeping the guide vehicle from becoming separated from the upper rails. For example, the wheeled assemblies may be conventional and of the type employed by roller coasters, or the like.

Figure 8:
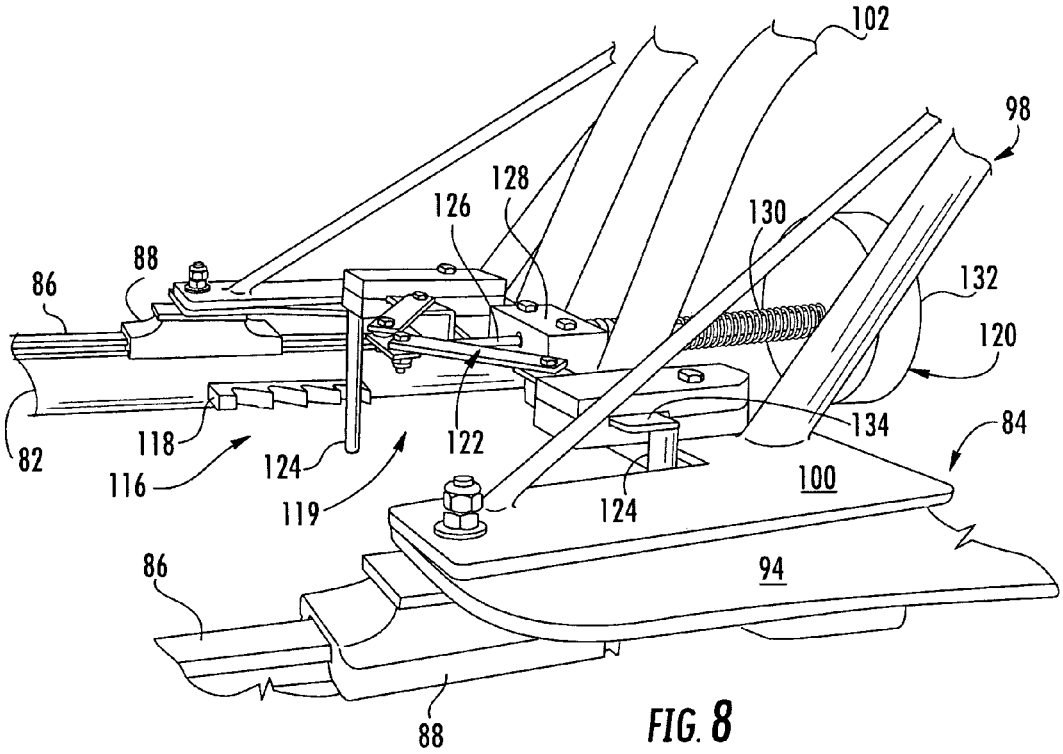
FIGS. 8 and 9 are isolated views of portions of an upper stand of a rack of the LARS.
Figure 9:
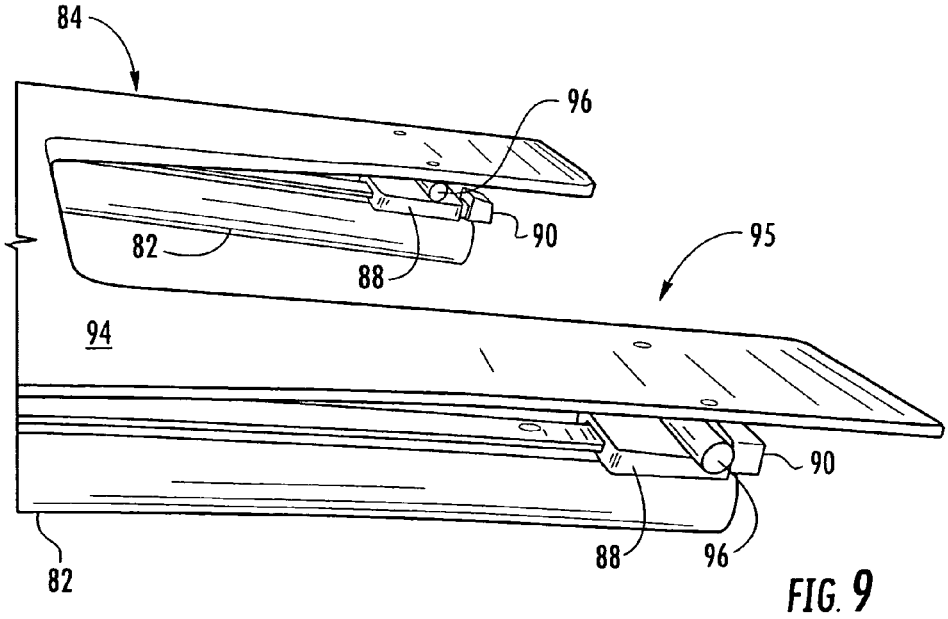
Figure 10:
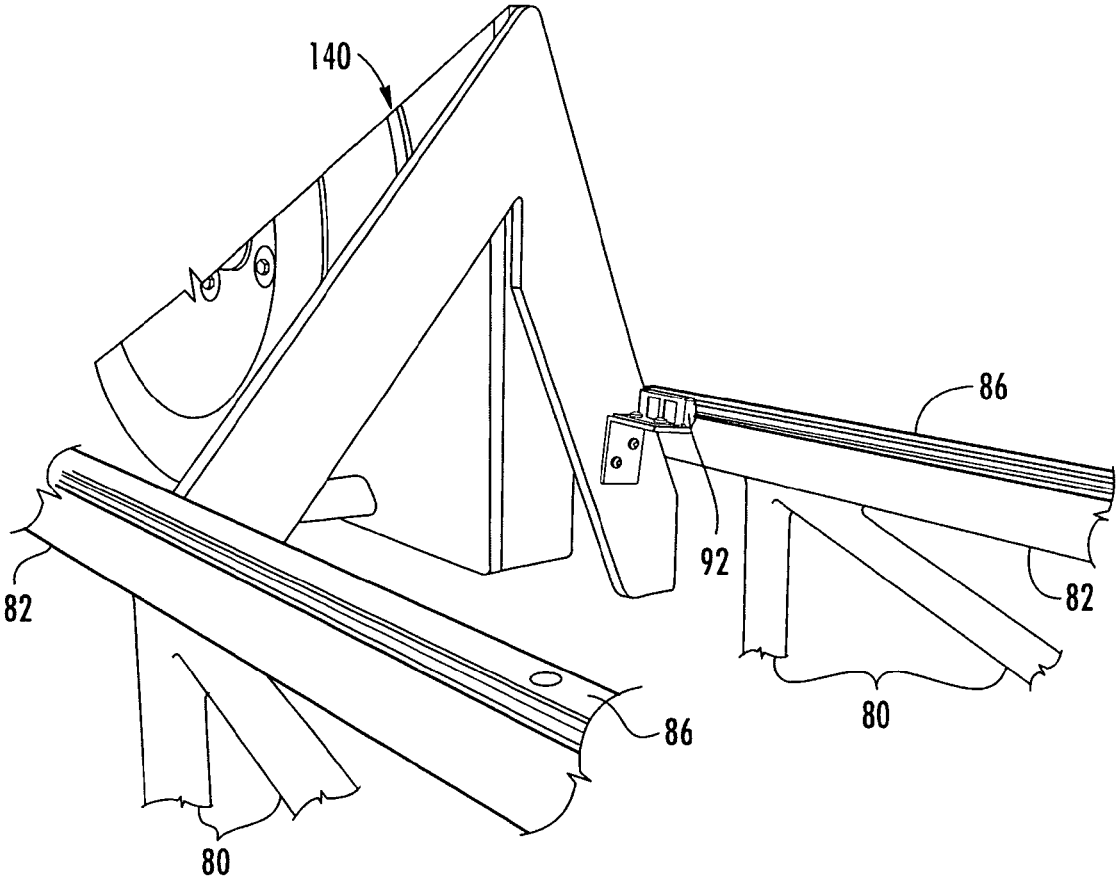
FIG. 10 is a rear pictorial view of a portion of the LARS.

As shown in greatest detail (although still at least somewhat schematically) in FIGS. 8 and 9, at each upper rail 82, the interface with the guide vehicle 84 includes a conventional track 86 fixedly mounted to and extending along the upper rail, and conventional carriers 88 interlockingly mounted to the track (for keeping each carrier from becoming separated from its respective track) and adapted for moving along the track. A conventional end stop 90 is fixedly mounted to the track, or otherwise obstructs travel along the track, for keeping the carriers from traveling off the rear end of the track. For example, suitable tracks 86, carriers 88 (e.g., travel cars) and end stops 90 may be obtained from Harken, Inc. As best understood with reference to FIG. 10, one or more sensors 92 may be fixedly mounted to, or proximate to, the track(s) 86 for providing a signal that seeks to restrict the rear carriers 88/guide vehicle 84 from traveling too far to the rear, as will be discussed in greater detail below.

As may be best understood with reference to FIG. 3, the guide vehicle 84 of the upper stand 68 includes an upper platform 94 that is somewhat, generally and/or substantially H-shaped, such that it has four appendages and an accommodating slot 95 that is upwardly, downwardly and rearwardly open slot. However, different types and configurations of platforms are within the scope of the present invention. For example, the upper platform 94 may be reinforced with one or more reinforcing plates, or the like.

As best understood with reference to FIGS. 8 and 9, the carriers 88 are mounted to the bottom of the upper platform 94, respectively at the upper platform's appendages. As shown in FIG. 8, the forward carriers 88 may be fixedly mounted to the bottom of the upper platform 94. In contrast and as shown in FIG. 9, the rearward carriers 88 are typically respectively mounted to the upper platform 94 by way of standoffs 96 (e.g., cylindrical members, concave members, or the like) interposed between the carriers and the platform, or by other suitable devices, so that at least the rear portion of the upper platform may flex a little bit relative to the rear carriers. This flexing is provided so that at least the rear portion of the upper platform 94 may flex and at least somewhat follow the curvature of the rear ends of the upper rails 82 when the guide vehicle 84 travels to the rear ends of the upper rails. The upper platform 94 may be fabricated from a low friction plastic board, composite board, or wooden board (e.g., marine plywood) that optionally may be covered with a lower friction material (e.g., plastic material, carpeting, or any other suitable material) so that the upper vehicle may slide relative to and along the upper platform 94. For example, the upper platform 94 may be constructed of materials used to make conventional boat trailer bunks.

As best understood with reference to FIG. 1, the guide vehicle 84 of the upper stand 68 further includes a bulkhead 98 mounted to and extending above the forward portion of the upper platform 94. The bulkhead 98 includes a rigid substructure 100 (e.g., base plate) and a rigid intermediate structure 102 (e.g., upright bars) that is fixedly connected to and extends upwardly from the substructure. Some of the bars of the intermediate structure 102 curve rearwardly. The upper end of the intermediate structure 102 is fixedly connected to and substantially rigidly supports an upper guide apparatus 104 that is positioned above the upper platform 94. In accordance with the exemplary embodiment, the upper guide apparatus 104 is rigid and includes a tapered guide passageway 106 and mounting wings 108 that extend laterally from the guide passageway.

The guide passageway 106 is for having a tow line (e.g., rope, cable, or the like) extend therethrough, as will be discussed in greater detail below. In accordance with the exemplary embodiment, the tapered guide passageway 106 is a tapered guide tube that defines annular front and rear openings 110, 112 (FIGS. 1 and 2), and a passage extending through the guide passageway between the front and rear openings. The interior surface of the guide passageway 106 extends around and defines the front and rear openings 110, 112, and the passage extending between the front and rear openings. The rear opening 112 is larger than the front 110 opening, and the passage substantially smoothly tapers between the rear and front openings. In accordance with the exemplary embodiment, cross-sections that are taken through the guide passageway's interior in isolation, with the cross-sections taken perpendicular to the length of the guide passageway 106, are annular, or more generally they are substantially annular. For example, the guide passageway 106 may be generally in the shape of a bell of a horn (e.g., trumpet or trombone), in the shape of a funnel, or any other suitable shape. In addition, the rear opening 112 may be encircled by an annular flange or lip that smoothly curves outwardly and forwardly. The guide passageway 106 may be shaped differently or replaced with another type of suitable mechanical guiding device.

During assembly, the wings 108 of the upper guide apparatus 104 include rearwardly open receptacles for respectively receiving the forwardly oriented ends of upright bars of intermediate structure 102 of the bulkhead 98. The upper guide apparatus 104 has a horizontal centerline, and may be formed from two identical pieces, a top piece and a bottom piece, that are in opposing face-to-face contact with one another at the horizontal centerline. Except for their opposite orientation, the top and bottom pieces, from which the upper guide apparatus 104 may be formed, may be identical. The top and bottom pieces of the upper guide apparatus 104 are typically firmly attached to one another with fasteners, such as nuts and bolts, so that the forwardly oriented ends of upright bars of the intermediate structure 102 of the bulkhead 98 are firmly gripped between the respective upper and lower parts of the wings 108.

Of course, numerous variations are within the scope of this disclosure. For example, any suitable guide passageway 106 may be used. For example, the guide passageway 106 may be mounted to the intermediate structure 102 of the bulkhead 98 using features other than the mounting wings 108, and the guide passageway may be formed differently than described above. For example, alternatively and theoretically, the guide passageway 106 may be in the form of, or may be defined by, a series of guide bars, guide rings and/or guide rollers that are arranged to define a relatively large rearward opening that tapers to a relatively small (e.g., nip-like) forward opening, or the like.

Figure 11:
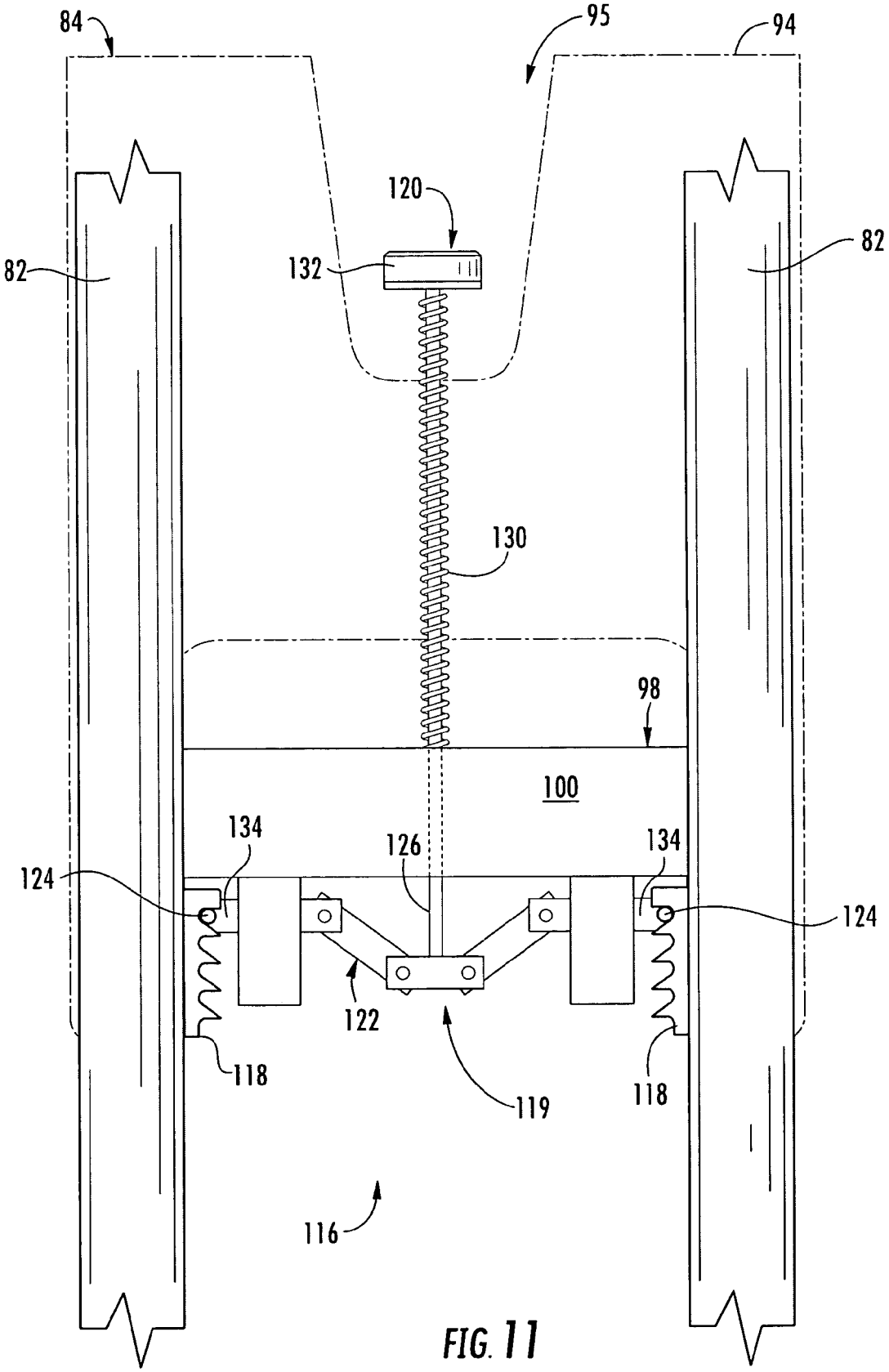
FIGS. 11 and 12 are isolated bottom plan views of a portion of the upper stand of the rack of the LARS, respectively showing a double-acting guide latch in its locked and unlocked configurations, while the guide vehicle of the upper stand is in its rearward position.
Figure 12:
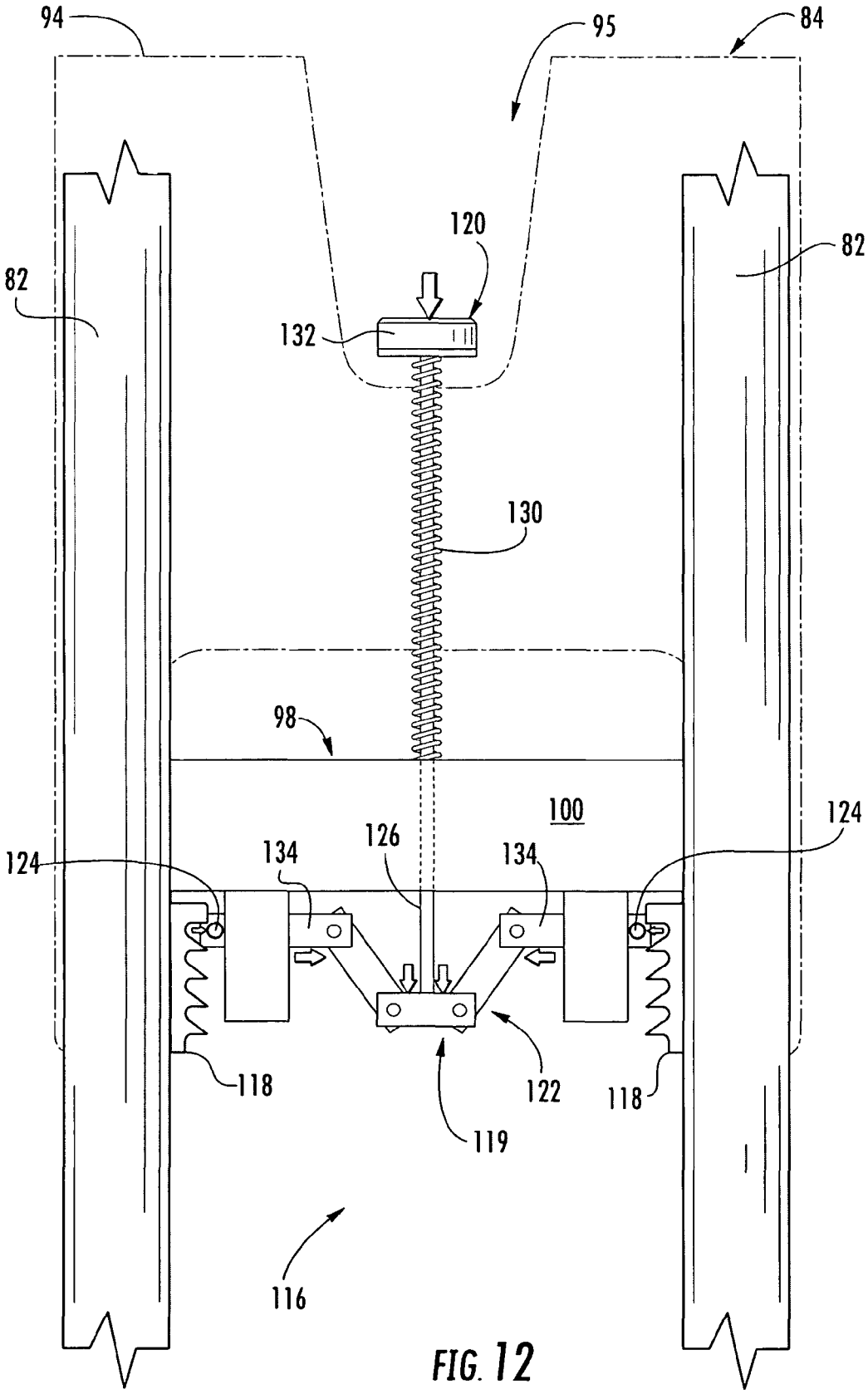

In accordance with the exemplary embodiment, the upper stand 68 includes one or more latches that may be operative between the guide vehicle 84 and the rack-like frame 60 for releasably securing the guide vehicle at the rear end of the upper stand 68. More specifically and as best understood with reference to FIGS. 8, 11 and 12, the one or more latches may be in the form of a double-acting guide latch 116. Most of the components of the guide latch 116 are shown in FIG. 8, which is generally a side, front, top perspective view of a portion of the upper stand 68 of the LARS 30, with the guide vehicle 84 in its rearward position. FIGS. 11 and 12 are isolated bottom plan views of a portion of the upper stand 68 with the guide vehicle 84 in its rearward position, respectively showing the guide latch 116 in its locked and unlocked configurations. A portion of the upper platform 94 is schematically illustrated by dashed lines in FIGS. 11 and 12.

The guide latch 116 includes first and second aspects that work together. The first aspect of the guide latch 116 includes receptacles that may be in the form of, or defined by, notched bars 118. The notched bars 118 are respectively fixedly mounted to the inwardly facing surfaces of the upper rails 82, at a position just forward of the downward curve in the upper rails. Spaces between the protrusions (e.g., teeth) of the notched bars 118 define the receptacles, and the number of protrusions/notches/teeth/receptacles may be increased or decreased and/or the positions of the notched bars may be changed depending upon the circumstances.

The second aspect of the guide latch 116 is a latching mechanism 119 that is carried by the guide vehicle 84 and includes a spring-loaded ram 120, linkage 122 and locking bolts 124. The ram 120 is an actuator for actuating the latching mechanism 119. The ram 120 is mounted to the bulkhead 98 for moving longitudinally back and forth along, and relative to, the bulkhead. The ram 120 includes a longitudinally extending triggering bar 126. The triggering bar 126 may be in the form of a cylindrical triggering rod, but may be in any other suitable form. The triggering bar 126 is movably mounted by virtue of extending through a longitudinal passageway that extends through a block-shaped mounting bearing 128 (FIG. 8) that is fixedly mounted to the substructure 100 of the bulkhead 98. The triggering bar 126 is biased by one or more springs, such as but not limited to a helical compression spring 130 that extends around the triggering bar 126. The compression spring 130 extends between (e.g., is compressed between) the mounting bearing 128 and a bumper 132 (e.g., disk-shaped bumper) fixedly mounted to the rear end of the triggering bar 126, so that the compression spring rearwardly biases (e.g., urges) the triggering bar.

The front end of the triggering bar 126 extends rearwardly from the mounting bearing 128 and is fixedly connected to a bar-shaped central link of the linkage 122. Opposite ends of the central link are respectively pivotably connected to inner ends of bar-shaped intermediate links of the linkage 122. The outer ends of the intermediate links are respectively pivotably connected to inner ends of bar-shaped end links 134 of the linkage 122. The extending end links 134 respectively extend laterally through laterally extending passageways that extend through block-shaped mounting bearings that are fixedly mounted to the substructure 100 of the bulkhead 98. Outer ends of the end links 134 protrude from their respective mounting bearings. The downwardly extending locking bolts 124 are respectively fixedly attached to the outer ends of the end links 134 for traveling with the end links.

The latching mechanism 119 is configured so that the end links 134 laterally reciprocate in response to longitudinal reciprocation of the triggering bar 126. For example, the latching mechanism 119 is configured for transitioning between an actuated state of the ram 120 shown in FIG. 12 (e.g., end links 134 and locking bolts 124 are laterally inward) and an unactuated state of the ram shown in FIG. 11 (e.g., end links and locking bolts are laterally outward). As shown FIG. 11, the ram 120 is not being actuated, so that the guide latch 116 is locked as a result of the locking bolts 124 respectively interacting with/being within receptacles of the notched bars 118. As shown FIG. 12, the ram 120 is actuated so that the guide latch 116 is unlocked, as will be discussed in greater detail below.

Whereas the guide latch 116 has been disclosed as being a double-acting latch, the present disclosure (e.g., present invention) is not limited to the use of a double-acting latch. For example, it may be suitable in some situations to use a single-acting latch, or in some situations the guide latch 116 may be omitted from the upper stand 68.

A majority of the bulkhead 98 and guide latch 116 may be made of metal pieces except, for example, the bumper 132 of the ram 120 may be at least partially made of polymeric material, or another material that is softer than metal, although it may also be made of metal, in which case it may be covered or capped with a softer material. As another example, the upper guide apparatus 104 may be made of strong and rigid polymeric material, carbon fiber material and/or any other suitable material. Typically the interior surface of the guide passageway 106 will be sufficiently smooth so as not to be too abrasive against the tow line extending therethrough. The relatively smooth interior surface of the guide passageway 106 can be provided by way of an inherent characteristic of the material from which the upper guide apparatus 104 is made or a smoothing machining process, a coating, a lining, or in any other suitable way.

Figure 2:
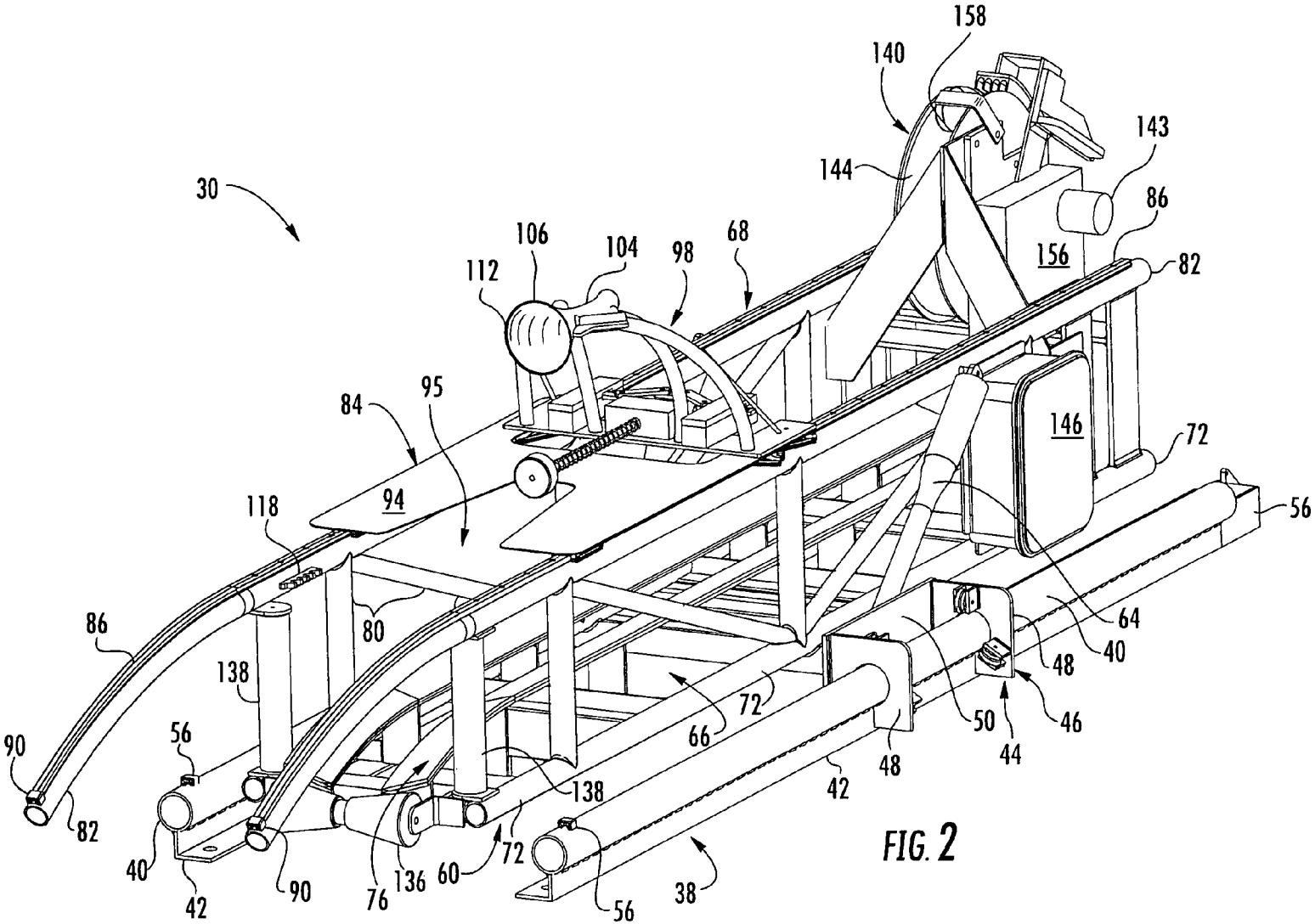
FIGS. 2-5 respectively are rear pictorial, top plan, left elevation and rear elevation views of the LARS in isolation and in the rearward stowed position, with a guide vehicle of the LARS in an intermediate position.
Figure 5:
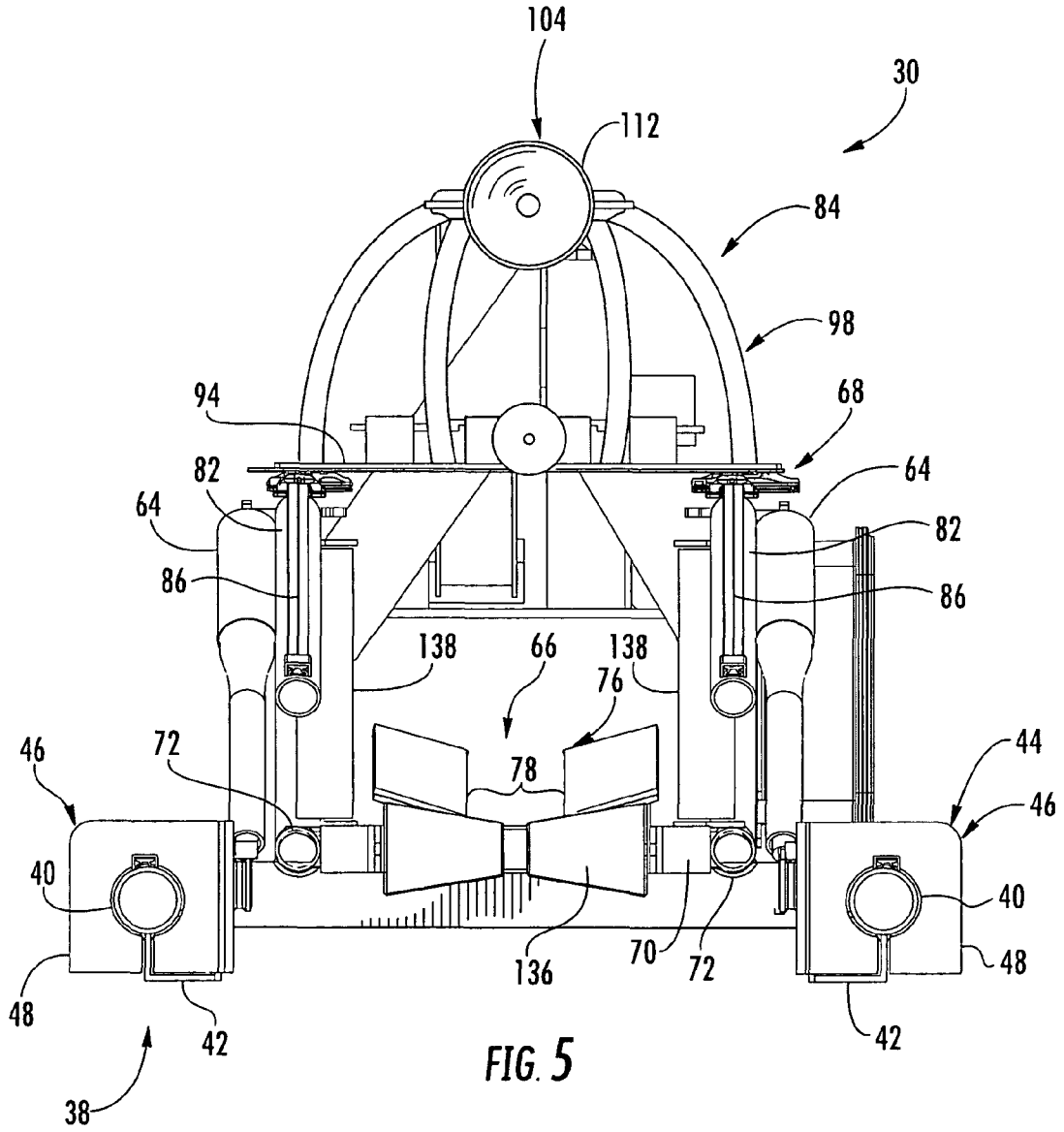
Figure 13A:
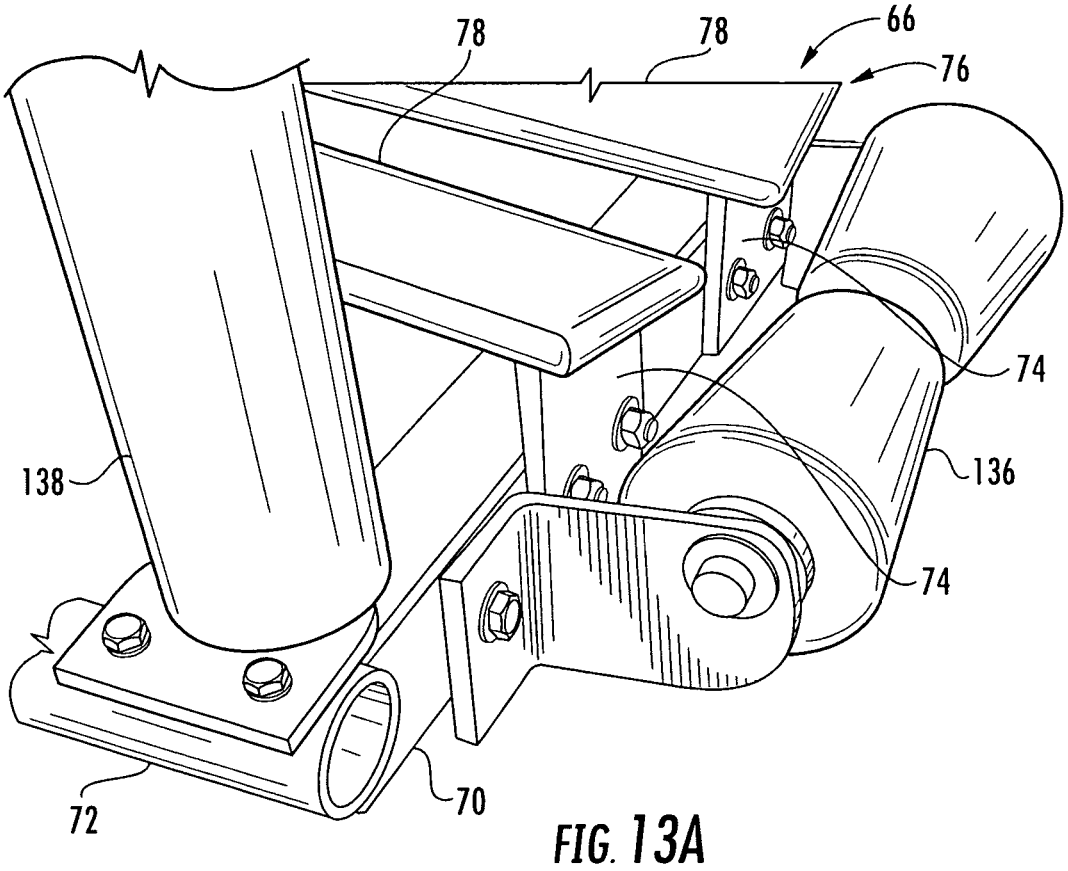
FIG. 13A is a rear perspective view of a portion of the rack-like frame of the LARS.

As best understood with reference to FIGS. 2, 5 and 13A, opposite ends of a rotatable, substantially horizontal guide roller 136 (e.g., keel roller) may be respectively mounted by way of brackets to the rearmost lower cross bar 70 extending between the rear ends of the longitudinal bars 72 of the lower stand 66, so that the horizontal guide roller is adjacent the rear end of the lower platform 76. As best understood with reference to FIGS. 2 and 5, opposite ends of rotatable, upright guide rollers 138 (e.g., keel rollers) may be respectively mounted by way of brackets respectively connected to the rear ends of the longitudinal bars 72 and the rear of the straight sections of the upper rails 82. The upright guide rollers 138 are laterally adjacent to the horizontal guide roller 136 and the end of the lower platform 76.

In accordance with the exemplary embodiment of this disclosure and as best understood with reference to FIGS. 1-4 and 13B, a winch 140 is fixedly mounted to the forward end of the rack-like frame 60 for moving with the frame. The winch 140 is for having four loops of a flexible tensile member (e.g., tow line 142) extend around the rotatable, cylindrical drum 144 of the winch. However, the winch 140 may be mounted in different locations (e.g., not on the frame 60, e.g., forwardly of the frame) and a different number of loops of the flexible tensile member may extend around the drum 144.

The winch 140 includes a motor 143 for driving rotation of the drum 144, and the winch typically includes an assembly of components and a controller 146 (e.g., more generally a controller 146 of the LARS) for controlling operation of the motor. For example, the assembly of components may be configured in a conventional manner so that the winch 140 operates as a motion compensating winch. Those of ordinary skill will understand that motion compensating winches are conventional, and that they may at least partially compensate for heave and/or surge conditions in a body of water when the winch 140 is retrieving or unreeling a tow line 142 with respect to the body of water. More specifically, when the winch 140 includes the motion compensating feature, it seeks to maintain constant tension in the tow line 142. However, the motion compensating feature of the winch 140 is optional and may be omitted.

Figure 13B:
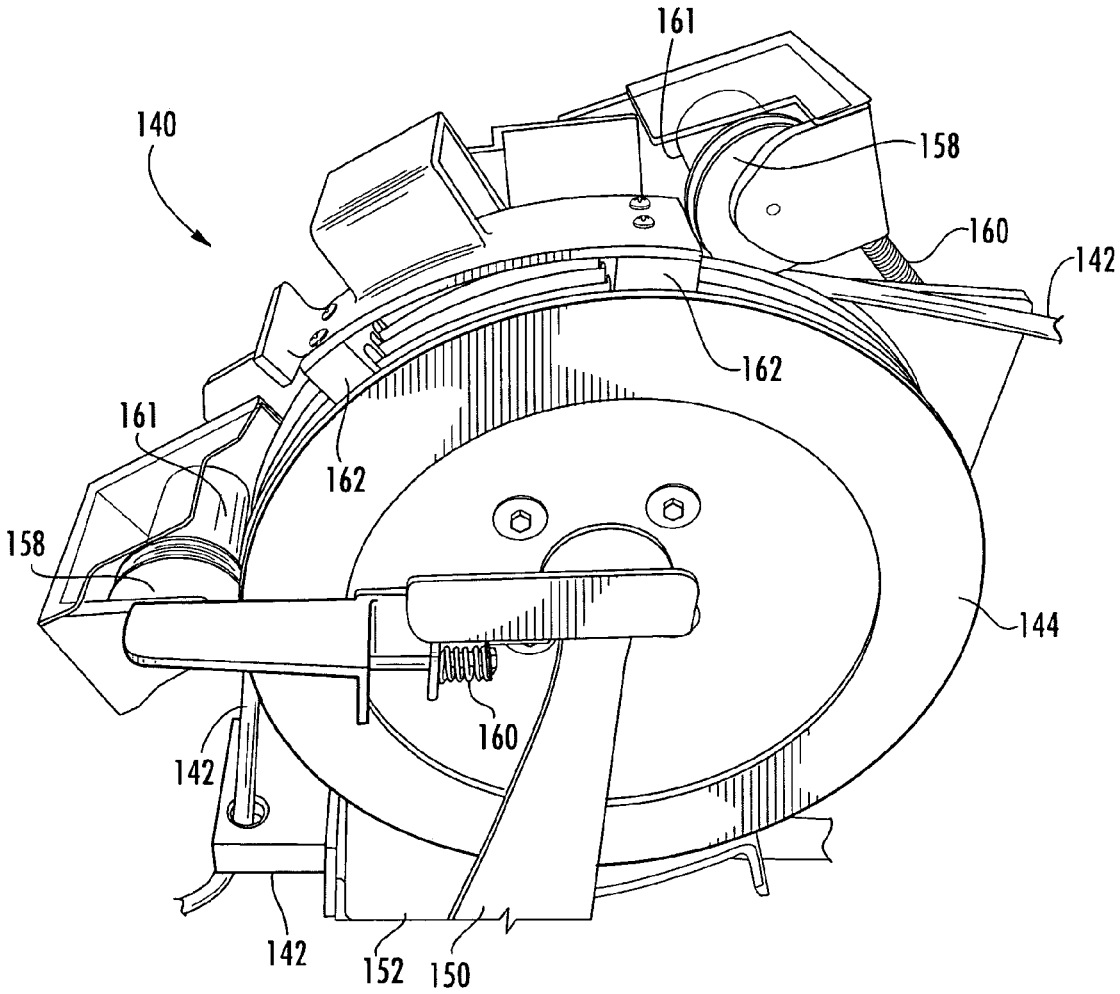
FIG. 13B is a right perspective view illustrating portions of a winch of the LARS.

Some of the details of the winch 140 may be best understood with reference to FIG. 13B. FIG. 13B is a right perspective view of a portion of the LARS, and FIG. 13B primarily illustrates the winch 140. The rotatable drum 144 is rotatably supported on the right side of the LARS 30 by an upright mounting bracket 150 that is fixedly connected to a cross bar 152 of the rack-like frame 60. On the left side of the LARS 30, the rotatable drum 144 is rotatably supported by an arrangement of structural supports that are fixedly connected to the frame 60. Also on the left side, the drum 144 is driven by way of a chain drive, gearing and/or any other suitable device(s) (not shown) that are interposed between the motor 143 and the drum. The chain drive, gearing and/or other suitable device(s), as well as some of the components for causing the winch 140 to operate as a motion compensating winch, may be at least partially concealed within a housing 156 (FIGS. 1 and 2) fixedly mounted to the frame 60.

In one particular example that may be best understood with reference to FIG. 13B, the winch 140 includes, or has associated therewith, forward and rearward nip rollers 158 that are respectively mounted around the axis of the drum 144 for being adjacent to the cylindrical surface of the drum. The nip rollers 158 are mounted by way of mounting brackets so that the nip rollers are both rotatable and movable toward and away from the drum 144. The nip rollers are biased (e.g., by respective helical tension springs 160) toward the drum 144 in a manner that seeks to prevent the loops of the tow line 142 (e.g., flexible tensile member) that extend around the drum from slipping on the cylindrical outer surface of the drum. The nip rollers 158 may be annularly grooved, so that the respective portions of the tow line 142 extend into the respective portions of the nip roller's grooves that are facing toward the drum.

In accordance with the exemplary embodiment of this disclosure, each of the nip rollers 158 is driven by a motor 161 (e.g., gear motor). Typically, the controller 146 (FIGS. 2 and 4) controls and coordinates operation of the motors 143, 161 so that, for each nip roller 158, the nip roller rotates in an opposite direction than the drum, and a point on the outer surface of the nip roller operates at approximately the same speed as an adjacent point on the outer surface of the drum 144. Alternatively, the motors 161 may be omitted, for example as discussed in greater detail below.

A relatively rearward portion of the tow line 142 is nipped between the left end of the cylindrical surface of the drum 144 and the rearward nip roller 158. A relatively forward portion of the tow line 142 is nipped between the right end of the cylindrical surface of the drum 144 and the forward nip roller 158. For mechanically guiding and helping to control the positioning of the left and right end-most loops of the tow line 142 that extend around the drum 144, the grooves of the nip rollers 158 face the cylindrical surface of the drum so that the grooves respectively receive and guide the end-most loops of the tow line. The grooves of the nip rollers 158 are in opposing face-to-face relation with the cylindrical surface of the drum 144 when the tow line 142 is not on the drum. More specifically and for each of the nip rollers 158, the two circumferential outer edges of the groove of the nip roller are typically in opposing face-to-face relation with the cylindrical surface of the drum 144 while the tow line extends through the nip between the nip roller and the drum.

Four loops of the tow line 142 extend around the drum 144 respectively in side-by-side arrangement. For mechanically guiding and helping to control the positioning of the loops of the tow line 142 that extend around the drum 144, guide bars 162 are respectively fixedly mounted around the axis of the drum 144 for being adjacent to the cylindrical surface of the drum. Each of the guide bars 162 includes four side-by-side grooves that extend circumferentially partially around the axis of the drum for having the loops of the tow line 142 respectively pass therethrough. The grooves of the guide bars 162 are in opposing face-to-face relation with the cylindrical surface of the drum 144 when the tow line 142 is not on the drum. More specifically and for each of the guide bars 162, the two circumferential outer edges of each groove of the guide bar are typically in opposing face-to-face relation with the cylindrical surface of the drum 144 while the tow line extends through the groove.

A guide bracket 164 includes a guide hole through which the tow line 142 extends as the tow line extends downwardly from the winch 140. As shown in FIG. 13B, the guide bracket 164 is fixedly mounted to the cross bar 152 of the rack-like frame 60.

Figure 16:
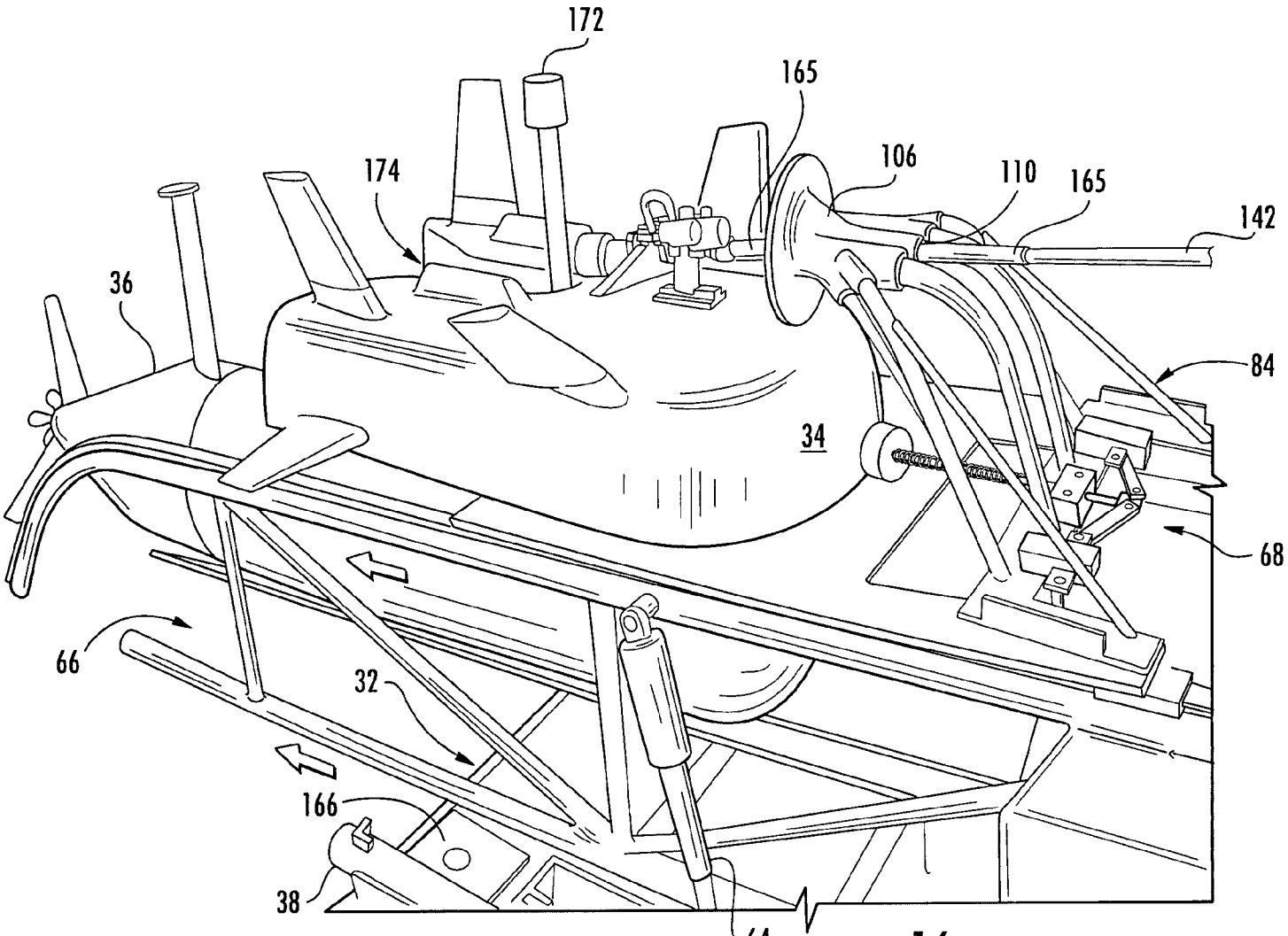

As best understood with reference to FIGS. 16, 18 and 19, a length of the rear end (e.g., about several feet) of the tow line 142 that is attached to the intercepting vehicle 34 typically comprises a stinger 165 (e.g., sheath) that increases the stiffness of the rear end of the tow line in a manner that seeks to aid in the launch and retrieval processes, as will be discussed in greater detail below. That is, the length of the tow line 142 that includes the stinger 165 is more rigid, on a per unit length basis, than the length of the tow line that does not include the stinger.

The stinger 165 may be in the form of a sheath of fiber-reinforced plastic or another suitable material that rigidifies the rear end of the tow line 142. For example, the stinger 165 may be formed by applying (e.g., wrapping and/or laying lengthwise) carbon fibers, strips of carbon fibers, or any other suitable rigidifying agent to the rear end of the tow line 142, and securing the fibers and/or other rigidifying agents in place on the tow line with plastic resin or another suitable adhesive or curing material. The stinger 165 may further include one or more rigid rods (e.g., metal or carbon rods) that extend parallel to the tow line 142 and are encased by the sheath component of the stinger. The stinger 165 helps in aligning the intercepting vehicle 34 with the upper stand 68 of the rack-like frame 60, as will be discussed in greater detail below.

As best understood with reference to FIGS. 14-28, examples of methods of using the LARS 30 for launching and recovering the vehicles 34, 36 are described in the following, in accordance with the exemplary embodiment of this disclosure. The base 38 of the LARS 30 is fixedly mounted to the deck 166 of the boat 32. Only a rear portion of the boat 32 is schematically shown in the drawings. For example, the LARS 30 may be mounted to the deck 166 of the boat 32 by mounting the base supports 42 to the deck of the boat with threaded nuts and bolts or any other suitable fasteners. The LARS 30 may be used on a variety of differently sized boats. The LARS 30 may be mounted to, and used on, a relatively small boat, so long, for example, as the boat 32 has a deck 166 that is large enough to accommodate the LARS 30, and the boat has a sufficient capacity (e.g., weight) rating for simultaneously carrying, for example, the LARS, intercepting vehicle 34 and retrievable vehicle 36. In accordance with the exemplary embodiment, the LARS 30 is designed to be light weight. For example, a substantial number of the metal components of the LARS 30 may be constructed of relatively light-weight metal, such as aluminum.

Figure 14:
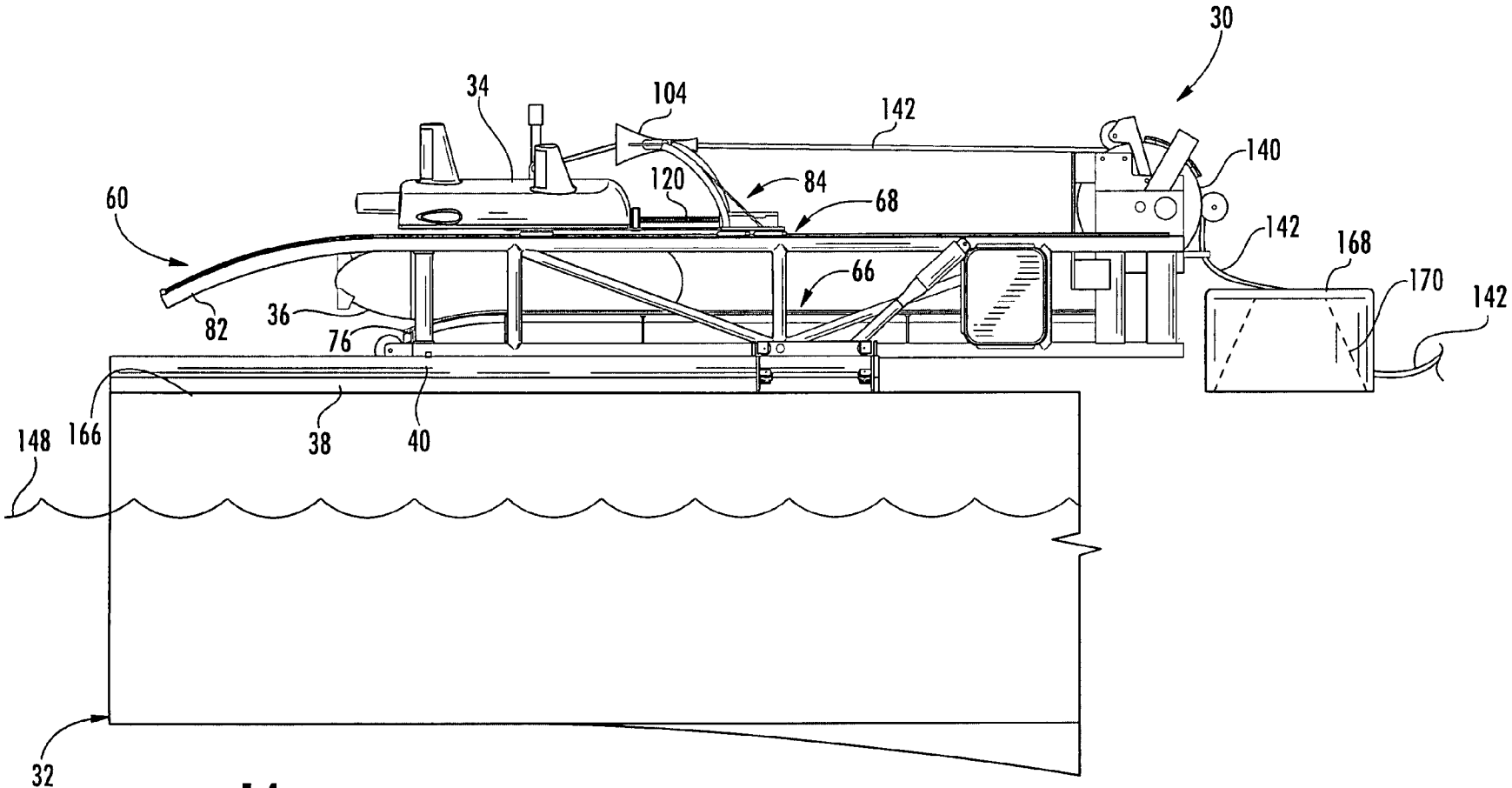
FIG. 14 is a partial, left elevation view of the LARS mounted at the rear end of a boat, with the LARS in a forward stowed position, and vehicles respectively upon the stands of the LARS.

Typically, the centerline of the boat 32 and the centerline of the LARS 30 are colinear, and the rear end of the LARS is adjacent the rear end of the boat while the LARS is in its forward stowed position shown in FIG. 14. The LARS 30 may be kept in the forward stowed position much of the time. In the stowed positions, the rack-like frame 60 extends substantially horizontally and substantially parallel to the deck 166, the frame 60 is not below the deck, and at least a majority of the frame 60 is forward of the rear end of the boat. Also in the stowed positions, the base rails 40, straight portions of the lower platform 76 and straight portions of the upper rails 82 are substantially parallel to one another.

A rearward, intermediate portion of the tow line 142 (e.g., flexible tensile member) is arranged on the winch 140 in the manner discussed above with reference to FIG. 13B. As best understood with reference to FIG. 14, a forward intermediate portion of the tow line may be coiled in a receptacle, such as a bucket 168. The bucket 168 may be fixedly mounted to the front end of the rack-like frame 60 for moving with the frame. A cone 170 (hidden from view and schematically illustrated by dashed lines in FIG. 14) may be in the bucket for promoting coiling of the tow line 142 around the cone in the bucket.

When the LARS 30 is used with the intercepting vehicle 34, the tow line 142 typically includes a cable for strength (e.g., a metal cable), a power-supply line for providing electrical power to the intercepting vehicle 34, and communication line(s) over which communications equipment (e.g., a transceiver) of the intercepting vehicle and communications equipment (e.g., a transceiver) of the boat 32 communicate with one another. The forward end of the tow line 142 extends from the bucket 168. The forward end of the cable for strength may be securely attached to the boat 32, the forward end of the power line(s) extend to a power supply (not shown) carried by the boat, and the forward end of communication line(s) extend to the respective operational components (not shown) (e.g., controllers, communication transceivers or other suitable devices) carried by the boat.

The rear end of the tow line 142 extends through the tapered guide passageway 106 so that the tow line enters into the rear opening 112 (FIG. 1) of the tapered guide passageway and emerges from the front opening 110 (FIG. 2) of the tapered guide passageway. When the LARS 30 is used with the intercepting vehicle 34, the connectors at the rear end of the tow line 142 (e.g., the connectors respectively at the ends of the cable for strength, the power-supply line and the communication line(s)) are typically too large to be passed through the tapered guide passageway 106. Therefore, the top and bottom pieces of the upper guide apparatus 104 may be separated from one another to fully open the passage extending between the front and rear openings 110, 112, so that the upper guide apparatus may be reassembled with the tow line 142 extending through the passage of the upper guide apparatus 104.

At any appropriate time (e.g., after the intercepting vehicle 34 is placed upon the LARS 30 as discussed in greater detail below), the rear end of the tow line 142 may be connected to the intercepting vehicle 34. More specifically, the rearward end of the cable for strength is securely attached to a tow fitting of the intercepting vehicle 34, and the power line and communication line(s) are respectively connected to connectors for operational components (not shown) (e.g., electrical power supply, controllers, communication transceivers or other suitable devices) carried by the intercepting vehicle.

As mentioned above, the winch 140 may be mounted in different locations (e.g., not on the frame 60, e.g., forwardly of the frame). Also, different types of winches may be used. For example, winch 140 may be replaced with a winch equipped with conventional slip ring(s) that handle the transfer of power and data, so that the tow line 142 may be substantially fully wound on the drum, and so that some of the features shown in FIG. 13B (e.g., the nip rollers 158, tension springs 160, motors 161 for driving the nip rollers 158, guide bars 162, guide bracket 164 and bucket 168) may be omitted.

In accordance with alternative embodiments in which the tow line 142 consists essentially of the cable for strength (e.g., when the power-supply line and the communication line(s) are omitted from the tow line), it may be possible to thread the tow line through the tapered guide passageway 106. Accordingly, the upper guide apparatus 104 may not include top and bottom pieces, or the like, that are for being separated from one another to fully open the passage extending between the front and rear openings 110, 112 (FIGS. 1 and 2).

The retrievable vehicle 36 may be initially placed upon the lower stand 66 of the LARS 30, or more specifically upon the lower platform 76 that is part of the lower stand, while the LARS 30 is in either of its stowed positions. For example, a crane or any other suitable device may be used to initially place the retrievable vehicle 36 upon the lower stand 66, or the initial placement may be done manually depending upon shape and weight of the retrievable vehicle. The rack-like frame 60 is substantially upwardly open, such that the lower stand 66 may be accessed from above, except where access is obstructed by the guide vehicle 84. Accordingly and for example, to make room for the retrievable vehicle 36 to be lowered onto the lower platform 76, the guide vehicle 84 may be moved as far as forwardly possible along the upper rails 82.

A majority of the retrievable vehicle 36 is typically positioned forwardly of the downwardly curved portions of the lower platform 76 while the LARS 30 is in either of its stowed positions. The rack-like frame 60 at least partially defines an enclosure that the retrievable vehicle 36 is positioned in while the retrievable vehicle 36 is upon the lower stand 66 and substantially forward of the downwardly curved portions of the lower platform 76. When the guide vehicle 84 is moved rearwardly over the retrievable vehicle 36, the upper platform 94 of the guide vehicle 84 forms a top of the enclosure mentioned immediately above, and a docking pole 172 that is fixedly mounted to and extends upwardly from the retrievable vehicle 36 extends through the accommodating slot 95 of the upper platform 94.

Prior to moving the guide vehicle 84 rearwardly over the retrievable vehicle 36, the intercepting vehicle 34 may be placed upon the upper stand 68 of the LARS 30, or more specifically upon the guide vehicle 84 of the upper stand, while the LARS 30 is in either of its stowed positions. For example, a crane or any other suitable device may be used to initially place the intercepting vehicle 34 upon the upper stand 68, or the initial placement may be done manually depending upon shape and weight of the retrievable vehicle. The intercepting vehicle 34 is typically placed upon the guide vehicle 84 so that an upwardly, downwardly and rearwardly open docking slot 174 (FIG. 16) of the intercepting vehicle 34 is above, open to and aligned with the accommodating slot 95 (FIG. 2) of the upper platform 94.

When the guide vehicle 84 together with the intercepting vehicle 34 is moved rearwardly over the retrievable vehicle 36, the docking pole 172 is received in both the accommodating slot 95 (FIG. 2) and the docking slot 174 (FIG. 16), so that the intercepting vehicle becomes adjacent to and latched to the retrievable vehicle. More specifically, the intercepting vehicle 34 typically includes a docking latch (e.g., a bear-claw type of latch, which is not shown) positioned in its docking slot 174, and the docking latch securely latches to the docking pole 172. That is, in accordance with the exemplary embodiment of this disclosure, latching together of the intercepting vehicle 34 and the retrievable vehicle 36 is by way of the docking latch and the docking pole 172, as may be further understood with reference to U.S. patent application Ser. No. 11/982,041, which was filed on Nov. 1, 2007, and has been previously incorporated herein by reference. Other methods and features for latching together the intercepting vehicle 34 and the retrievable vehicle 36, or other vehicles, are also within the scope of the present invention.

In the stowed positions of the rack-like frame 60, the guide vehicle 84 is typically forward of the downwardly curved portions of the upper rails 82. While the LARS 30 is in the stowed position and the intercepting vehicle 34 is upon the guide vehicle 84, the rear end of the intercepting vehicle may extend rewardly of the guide vehicle. After the intercepting vehicle 34 and the retrievable vehicle 36 are latched together by way of the docking latch and docking pole 172 in the position shown in FIG. 14, the winch 140 may be operated to pull the vehicles 34, 36, 84 forwardly along their respective stands 66, 68. The operation of the winch 140 may be automatically ceased in response to the sensor 92 (FIG. 10) detecting the presence of the respective carrier 88 (FIG. 8), or the like.

While the intercepting vehicle 34 and the retrievable vehicle 36 are latched together by way of the docking latch and docking pole 172 in the position shown in FIG. 14 or in a farther forward position, the vehicles 34, 36 are very secure because, for example, of the retrievable vehicle 36 being enclosed (e.g., substantially enclosed) as discussed above, the front of the intercepting vehicle 34 being securely engaged against the spring-loaded ram 120, and tension in the tow line 142. Alternatively, the spring-loaded ram 120, or at least a portion thereof, may be omitted, as will be discussed in greater detail below.

With the vehicles 34, 36 securely upon the LARS 30 as described above, the boat 32 may be operated to transport the vehicles to a launch site. FIGS. 15-21 illustrate an example of a sequence of launching the vehicles 34, 36 respectively from the stands 66, 68 of the rack-like frame 60, as will be discussed in the following in accordance with the exemplary embodiment of this disclosure.

Figure 17:
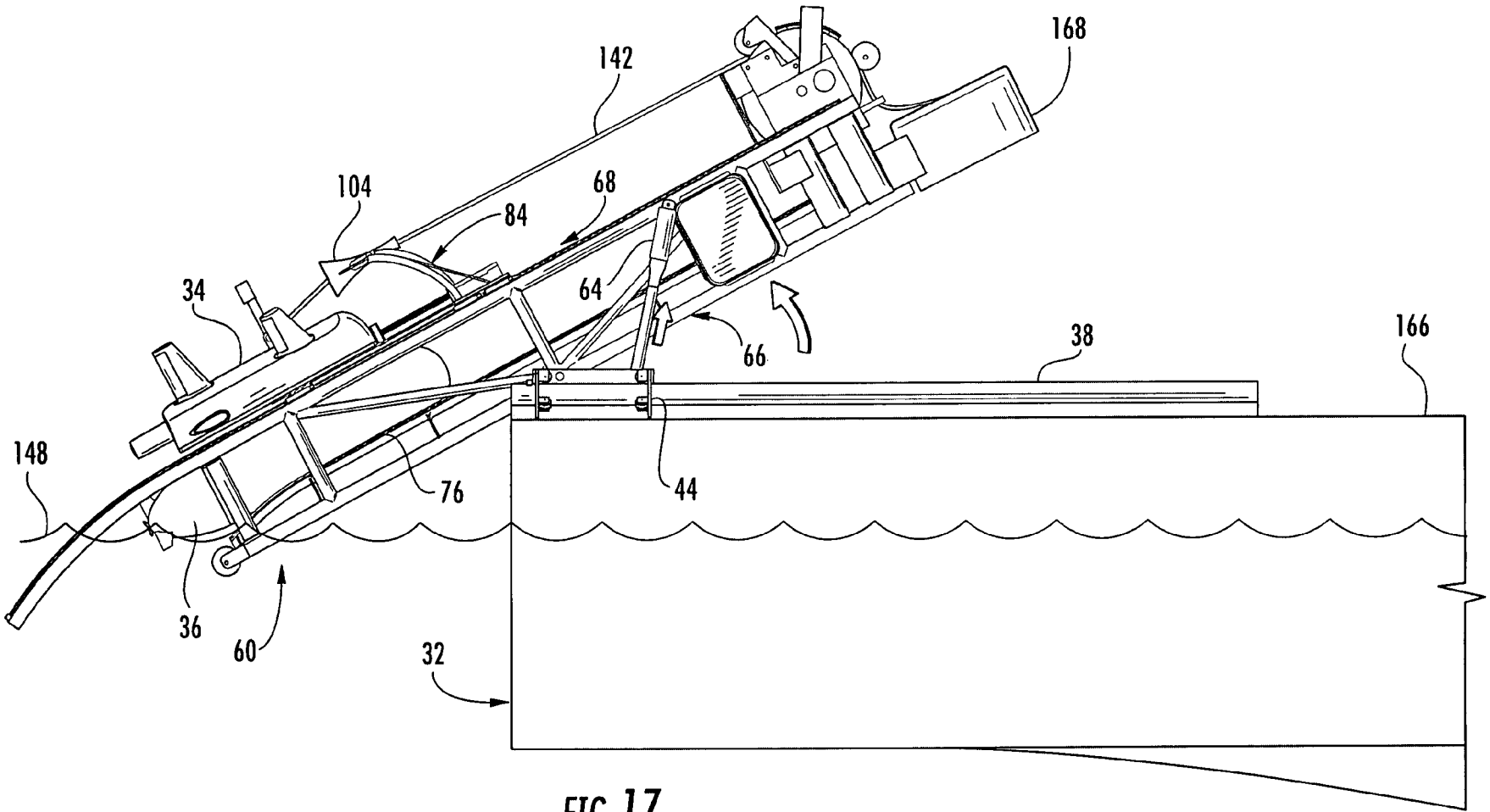

For launching the vehicles 34, 36 while they are securely connected to one another by way of the docking latch of the intercepting vehicle being latched to the docking pole 172 of the retrievable vehicle, the rack-like frame 60 is moved relative to both the base 38 and the boat 32 from the stowed position (FIG. 14) to a deployed position (FIG. 17). To achieve the deployed position, first the carriage actuators 58 (FIGS. 1, 3 and 7) are actuated to cause the carriage 44 to move (e.g., translate) rearwardly along the base rails 40, and the carriage carries the rack-like frame 60 and vehicles 34, 36 with it, as shown in FIGS. 15 and 16.

Figure 15:
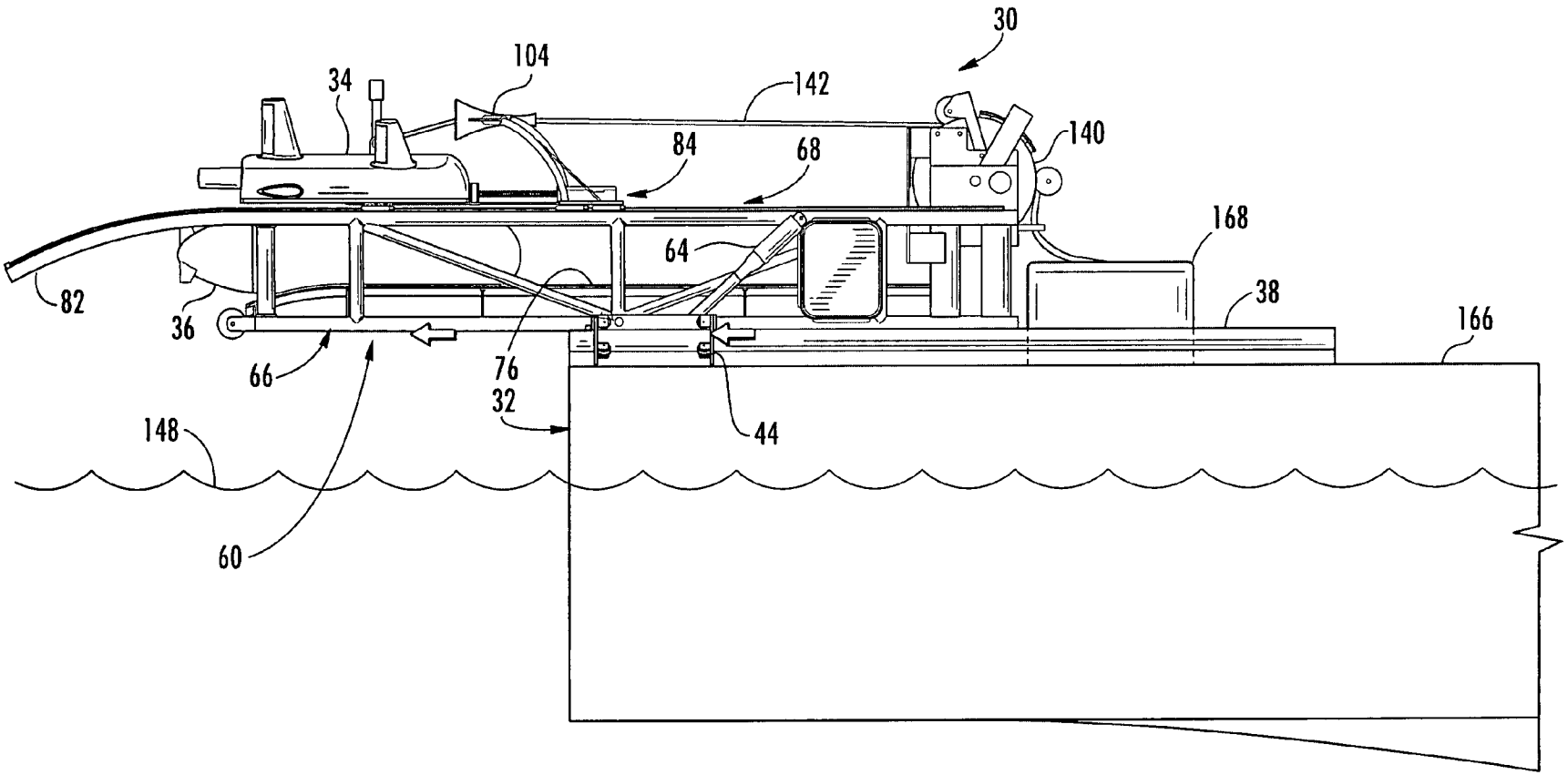
FIGS. 15-21 are partial, left elevation views of the LARS mounted at the rear end of the boat, and they illustrate a sequence of launching the vehicles using the LARS.

After the carriage 44 reaches its rearward position shown in FIG. 15, then the frame actuators 64 are actuated to pivot the rack-like frame 60 and cause it to become inclined, so that the frame is in the deployed position, as shown in FIG. 17. In the deployed position, the rear end of each of the frame 60, upper stand 68 and lower stand 66 is at a lower elevation than it was in the stowed position. Typically in the deployed position, the rear end of each of the stands 66, 68 is below the surface of the body of water 148 that the boat 32 is in. Only the surface of the body of water 148 is schematically shown in FIGS. 14, 15 and 17-28. As shown in FIGS. 14, 15 and 17-28, the deck 166 of the boat 32 is typically above the surface of the body of water 148.

Typically the propulsion system of the boat 32 is operated so that the boat is moving forward at relatively slow speed (e.g., several knots per hour) in the body of water 148 while the LARS 30 is in the deployed position and the vehicles 34, 36 are launched. In accordance with the exemplary embodiment, the boat's propulsion system in and of itself is conventional and includes inboard motor(s) (not shown) and propeller(s) (not shown) that protrude from the rear end of the boat, so that the propellers are below the surface of the water 148 and beneath the rear end of the rack-like frame 60 when the LARS 30 is in the deployed configuration.

Figure 18:
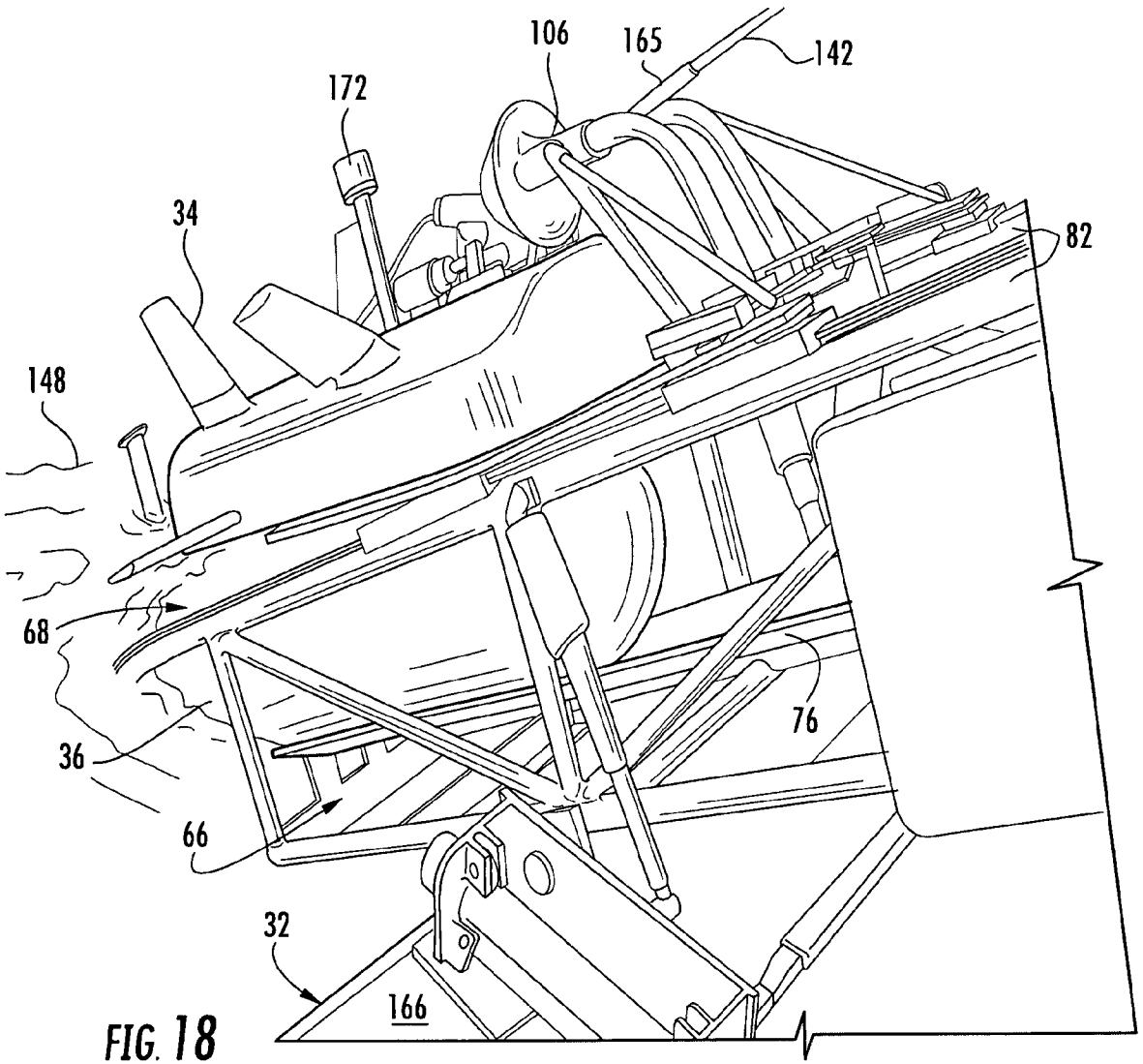
Figure 19:
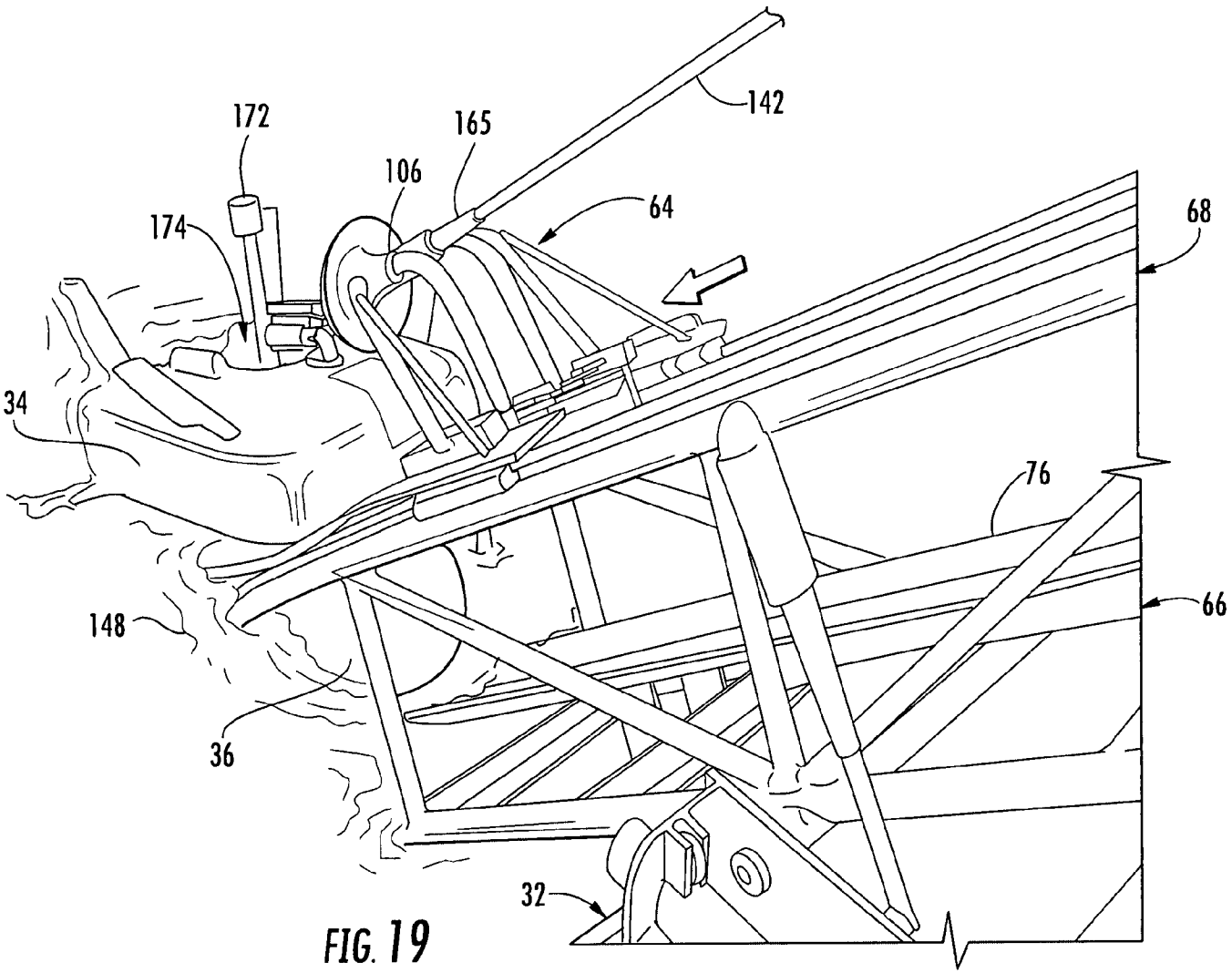
Figure 20:
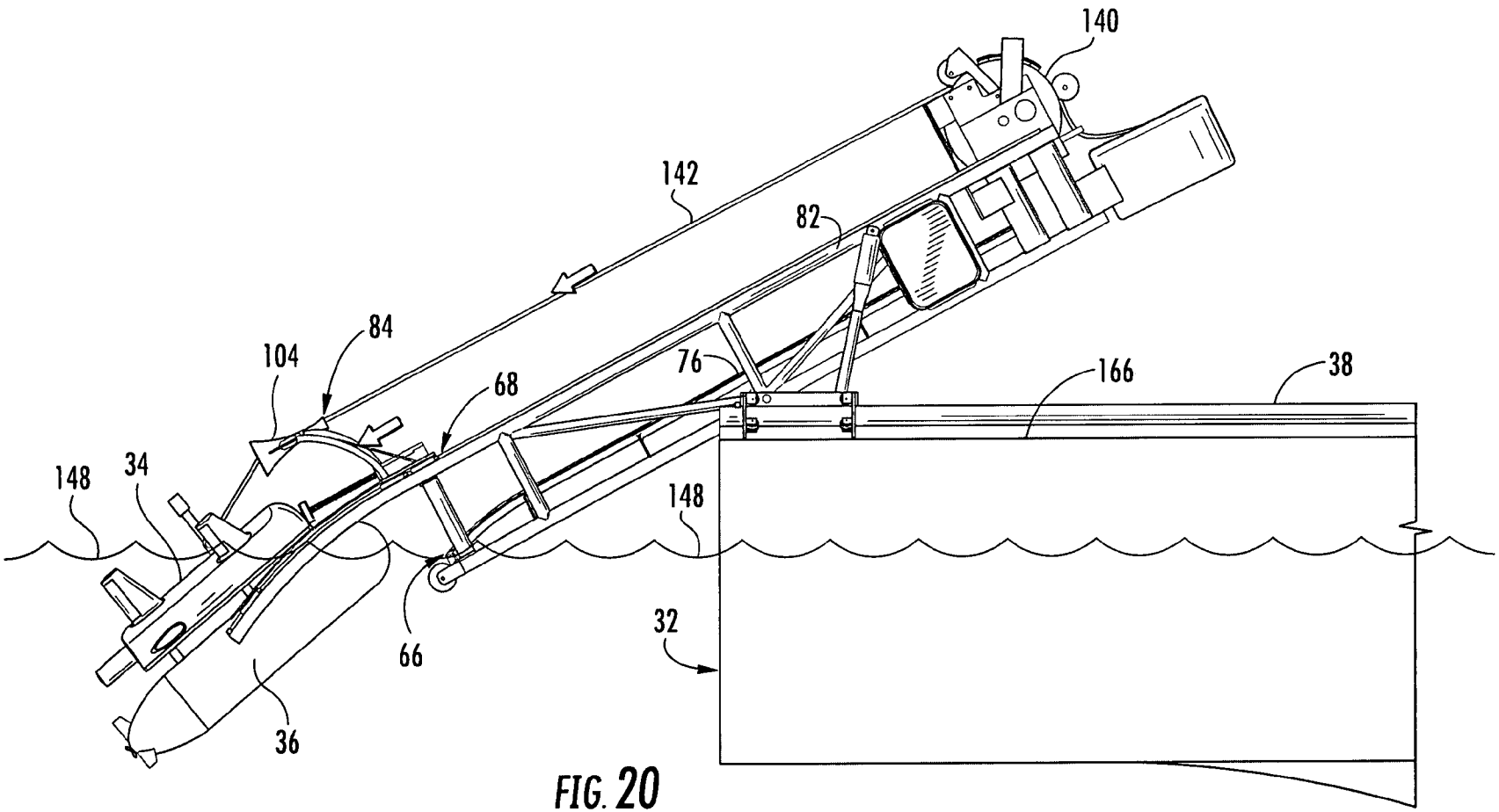

With the LARS 30 in the deployed configuration, the winch 140 is operated to let out the tow line 142, so that the intercepting vehicle 34 and the retrievable vehicle 36, which are still connected to one another by way of the docking latch of the intercepting vehicle being latched to the docking pole 172 of the retrievable vehicle 36, move rearward and downward respectively along the upper and lower stands 66, 68 and into the water 148, under the force of gravity, as shown in FIGS. 18-20. The retrievable vehicle 36 moves rearwardly and downward along the lower stand 66 by virtue of the lower surface of the retrievable vehicle 36 sliding along the lower platform 76.

Initially, the intercepting vehicle 34 moves rearwardly and downward along the upper stand 68 by virtue of the guide vehicle 84 moving rearwardly and downward along the upper rails 82 under the force of gravity, without the intercepting vehicle sliding relative to the guide vehicle. While the intercepting vehicle 34 is upon the guide vehicle 84 and the rear carriers 88 (FIG. 9) are forward of the end stops 90 (FIG. 9), the intercepting vehicle is typically sufficiently forward on the guide vehicle so that the front end of the intercepting vehicle is engaged to the rear end of the ram 120 in a manner that causes the latching mechanism 119 to remain in its unactuated state shown in FIG. 12.

However, when the rear carriers 88 (FIG. 9) engage the end stops 90 (FIG. 9), which arrest the movement of the guide vehicle 84, the intercepting vehicle 34 slides rearwardly and downwardly across and off the upper platform 94 into the water 148. As a result, the intercepting vehicle 34 is disengaged from the rear end of the ram 120 in a manner that causes the latching mechanism 119 to transition into its actuated state shown in FIG. 11. As a result, the guide latch 116 becomes locked as shown in FIG. 11 to hold the guide vehicle at the rear end of the upper rails 82 with the rear carriers 88 respectively engaged to the end stops 90. That is, the notched bars 118 are positioned so that while the guide vehicle 84 is at its rearward position and the ram 120 is no longer pressed forward, the locking bolts 124 are respectively received in receptacles of the notched bars 118 and remain there due to the bias of the compression spring 130, so that the locked guide latch 116 holds the guide vehicle in its rearward position. That is, the guide latch 116 is automatically locked when the guide vehicle 84 is proximate the rear end of the upper stand 68, in response to the intercepting vehicle 34 disengaging from the ram 120.

As soon as the vehicles 34, 36 come into contact with the water 148, water currents, heave and/or surge conditions may apply forces against the vehicles 34, 36 in a manner that might tend to interfere with a controlled launch of the vehicles 34, 36. The LARS 30 is designed in a manner that seeks to counter any disruptive water currents, heave and/or surge conditions. For example, the rigidity provided by the stinger 165 (FIGS. 16, 18 and 19) extending through the guide passageway 106 seeks to restrict undesirable movement of the vehicles 34, 36 by mechanically guiding the intercepting vehicle 34. More specifically, rigidity provided by the stinger 165 extending through the guide passageway 106 seeks to align the intercepting vehicle 34 with the upper stand 68 of the rack-like frame 60.

Figure 21:
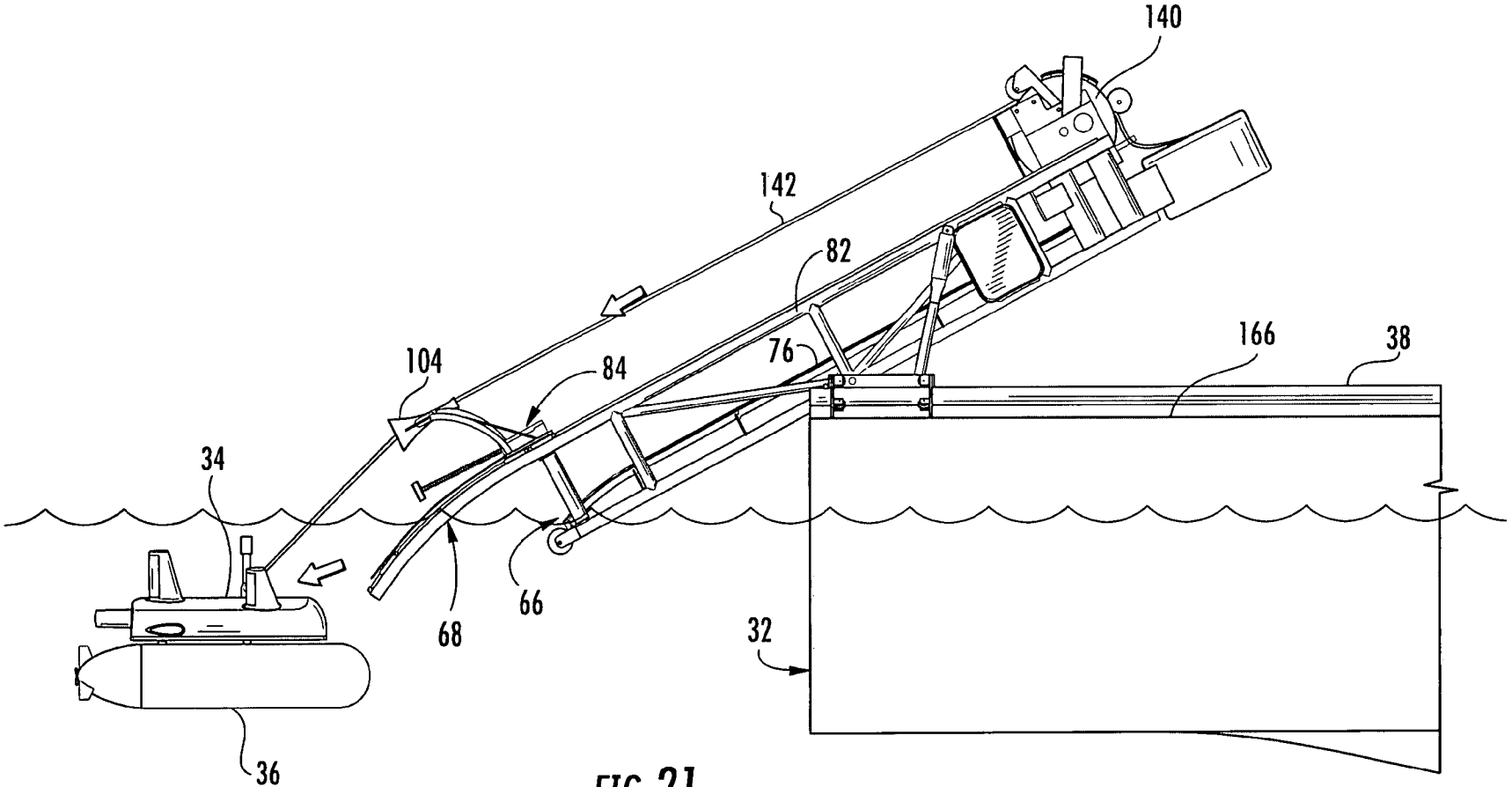
Figure 22:
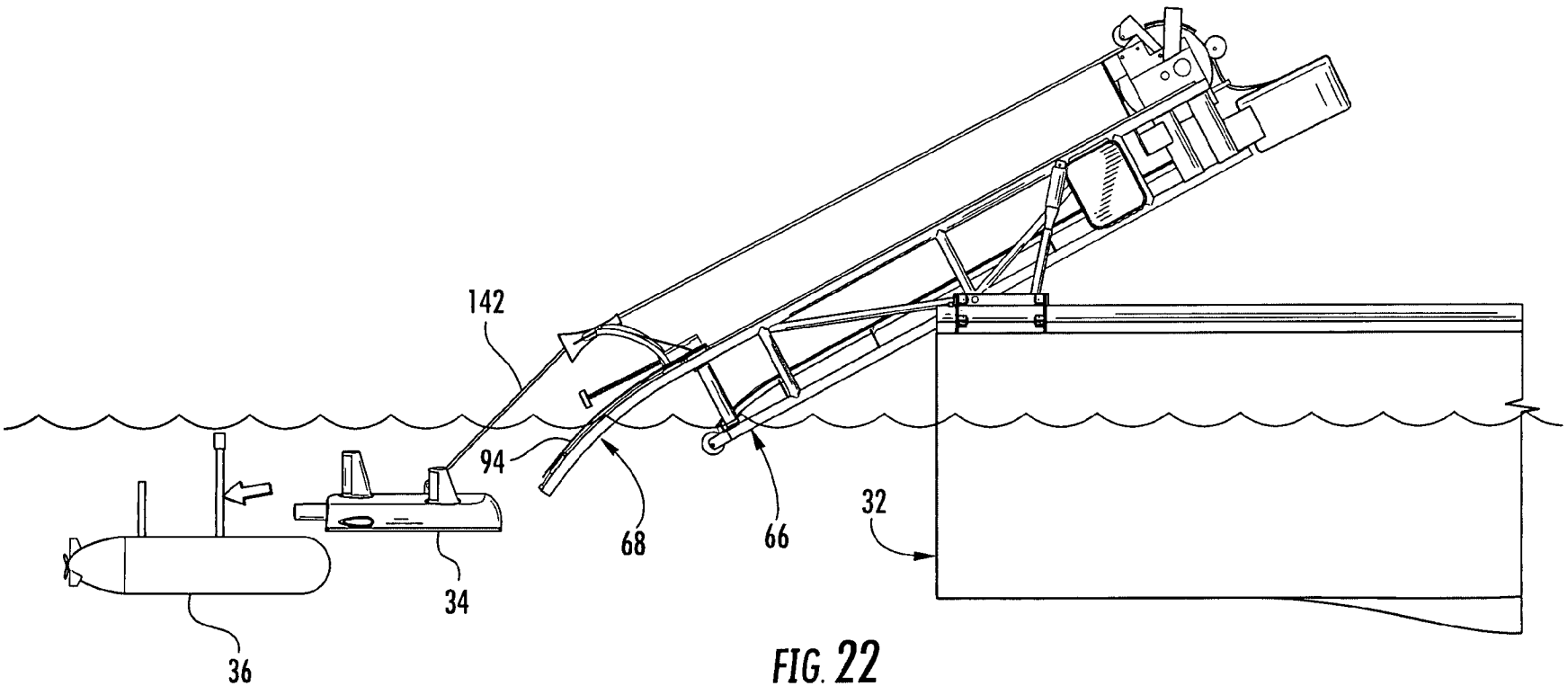
FIG. 22 is partial, left elevation view of the LARS mounted at the rear end of the boat, and it illustrates the launched vehicles being separated from one another in the body water.

Referring to FIG. 21, as the winch 140 continues to unreel the tow line 142, the intercepting vehicle 34 and the retrievable vehicle 36, which are still connected to one another by way of the docking pole 172 and the docking latch, move rearwardly away from the LARS 30 and the boat 32, for example due to the boat propelling itself (slowly) forward. Referring to FIG. 22, the docking latch of the intercepting vehicle 34 may be opened to release the retrievable vehicle 36 from the intercepting vehicle 34, and thereafter the retrievable vehicle may be operated, such as in a manner that is conventional for unmanned underwater vehicles. FIG. 22 may be schematic because, for example, the vehicles 34, 36 are typically farther rearward from the boat 32 when the retrievable vehicle 36 is undocked from (e.g., released from) the intercepting vehicle 34.

The intercepting vehicle 34, without the retrievable vehicle 36, may be recovered and released using the LARS 30. Recovering the intercepting vehicle 34 without the retrievable vehicle 36 is generally like recovering the intercepting vehicle with the retrievable vehicle, except that the retrievable vehicle is not present. Similarly, releasing the intercepting vehicle 34 without the retrievable vehicle 36 is generally like releasing the intercepting vehicle with the retrievable vehicle, except that the retrievable vehicle is not present.

Figure 23:
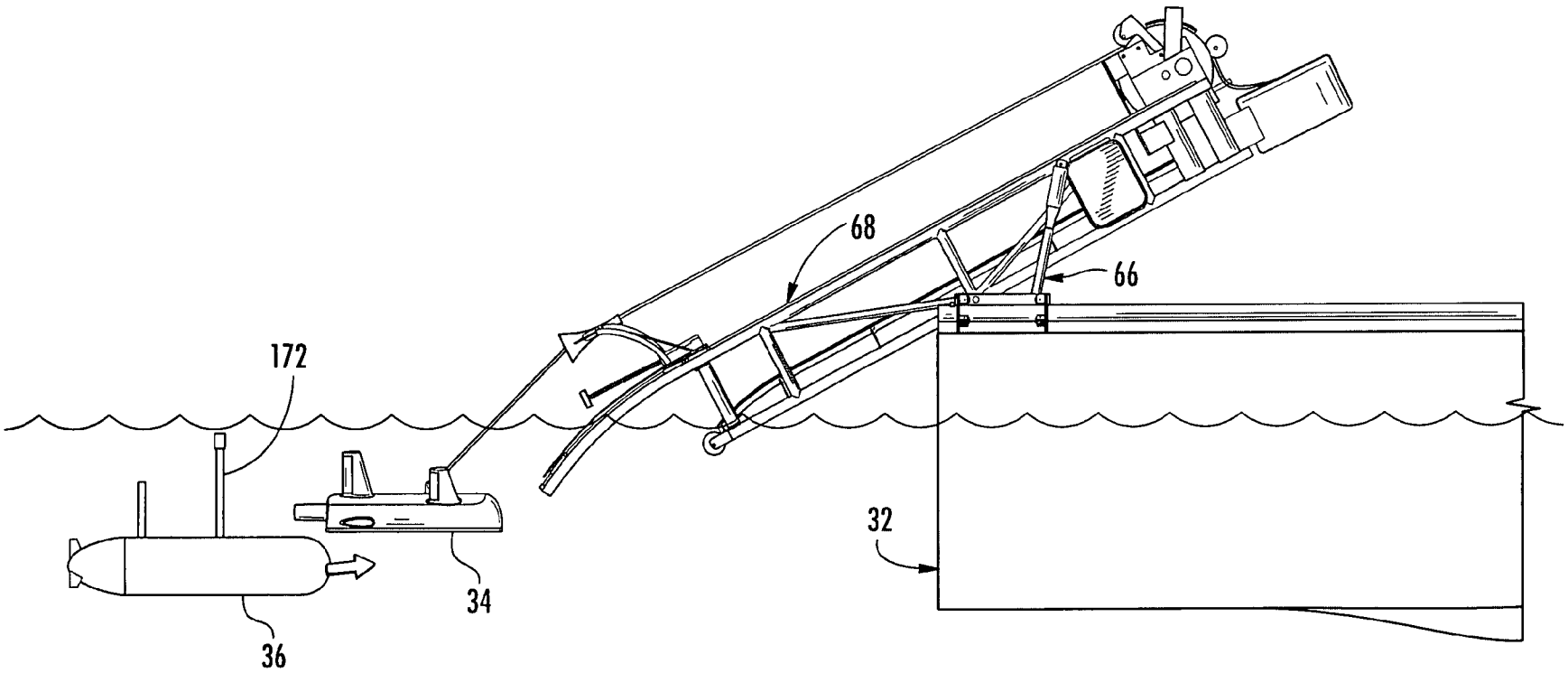
FIG. 23 is partial, left elevation view of the LARS mounted at the rear end of the boat, and it illustrates the launched vehicles in the process of becoming docked to one another.

When both the intercepting vehicle 34 and the retrievable vehicle 36 are to be substantially simultaneously recovered by the LARS 30, first the intercepting vehicle is docked to the retrievable vehicle while the vehicles 34, 36 are submerged in the body of water 148. This docketing may be carried out in the manner described in U.S. patent application Ser. No. 11/982,041, which is filed on Nov. 1, 2007, and has been previously incorporated herein by reference. The retrievable vehicle 36 approaching the intercepting vehicle 34 from the rear, and the intercepting vehicle homing in on the retrievable vehicle, as part of the process of the docking between the vehicles 34, 36, is schematically shown in FIG. 23. FIG. 23 may be schematic because, for example, the vehicles 34, 36 are typically farther rearward from the boat 32 when the retrievable vehicle 36 is docked to the intercepting vehicle 34.

During the docking, the retrievable vehicle 36 travels faster than and catches up to the intercepting vehicle 34 while the intercepting vehicle (and also the boat, as/if needed) maneuvers so that the docking pole 172 enters the docking slot 174 (FIG. 16) and the intercepting vehicle's docking latch latches to the lower portion of the docking pole. That is and referring to FIG. 24, the docking is carried out so that the intercepting vehicle 34 and the retrievable vehicle 36 are adjacent to one another and connected to one another by way of the docking latch of the intercepting vehicle being latched to the docking pole 172 of the retrievable vehicle. However, the vehicles 34, 36 may be brought together, so as to be adjacent to one another and connected to one another, in any suitable manner.

Figure 24:
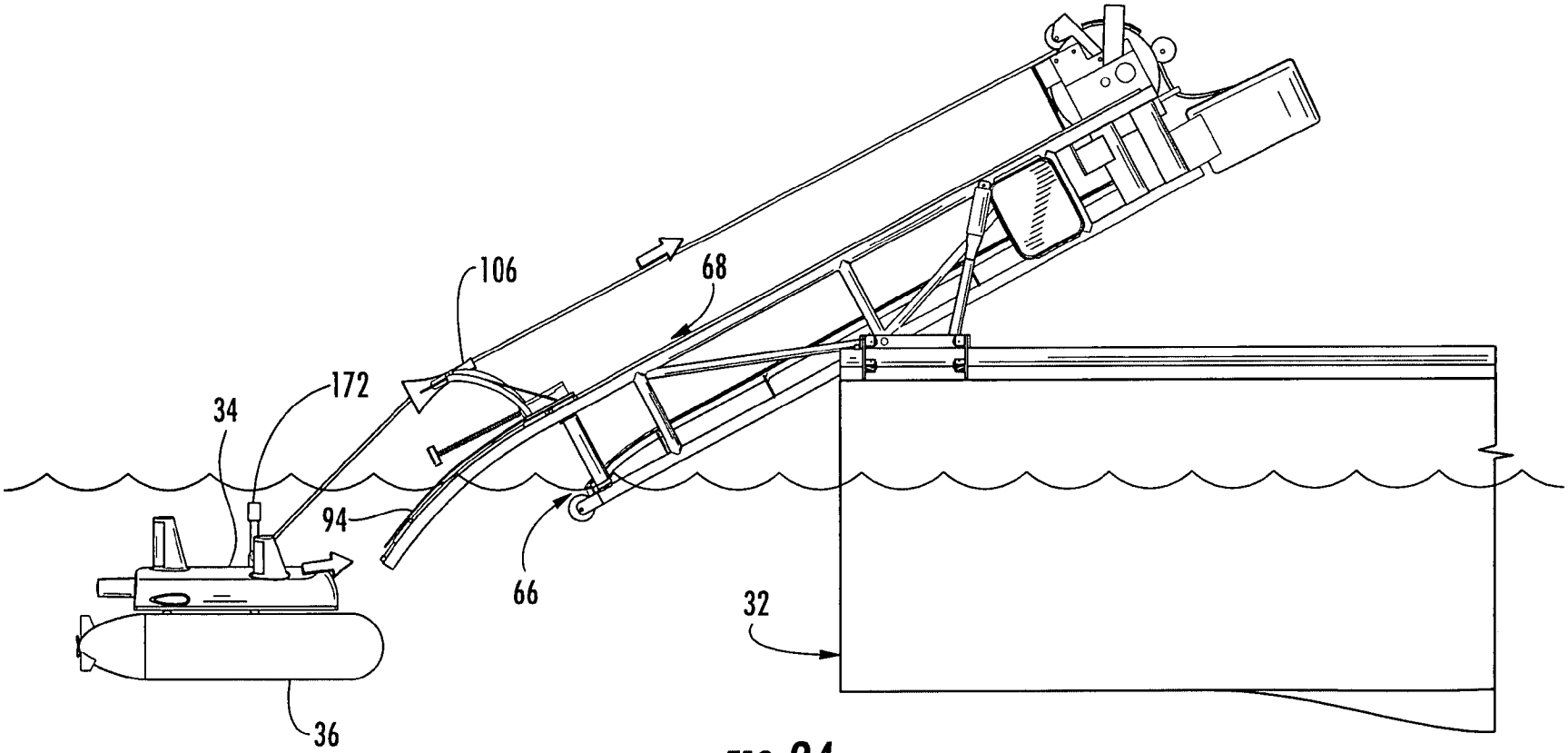
FIGS. 24-28 are partial, left elevation views of the LARS mounted at the rear end of the boat, and they illustrate a sequence of recovering the vehicles using the LARS.

FIGS. 24-28 illustrate an example of a sequence of recovering the vehicles 34, 36 respectively to the stands 66, 68 of the rack-like frame 60, as will be discussed in the following in accordance with the exemplary embodiment of this disclosure. Throughout the recovering process, the intercepting vehicle 34 and the retrievable vehicle 36 are typically securely docked to one another by way of the docking latch of the intercepting vehicle being securely latched to the docking pole 172 of the retrievable vehicle. While the vehicles 34, 36 are docked to one another, the rack-like frame 60 is in the deployed position, and the locked guide latch 116 holds the guide vehicle 84 in its rearward position, the substantially simultaneously recovery of the vehicles 34, 36 is initiated by operating the winch 140 to pull the latched together vehicles 34, 36 toward the rear end of the frame 60, as schematically shown in FIG. 24. As the winch 140 is operated to draw in the tow line 142, the tapered guide passageway 106 guides the tow line so that the lower front end of the intercepting vehicle 34 engages the upper surface of the guide vehicle's upper platform 94 proximate the rear end of the upper platform. More specifically, as the front end of the intercepting vehicle 34 approaches the upper platform 94, the front end of the relatively rigid stinger 165 (FIGS. 16, 18 and 19) extends through the guide passageway 106, and the stinger and the guide passageway cooperate in a manner that seeks to keep the intercepting vehicle longitudinally aligned with the upper stand 68.

Figure 25:
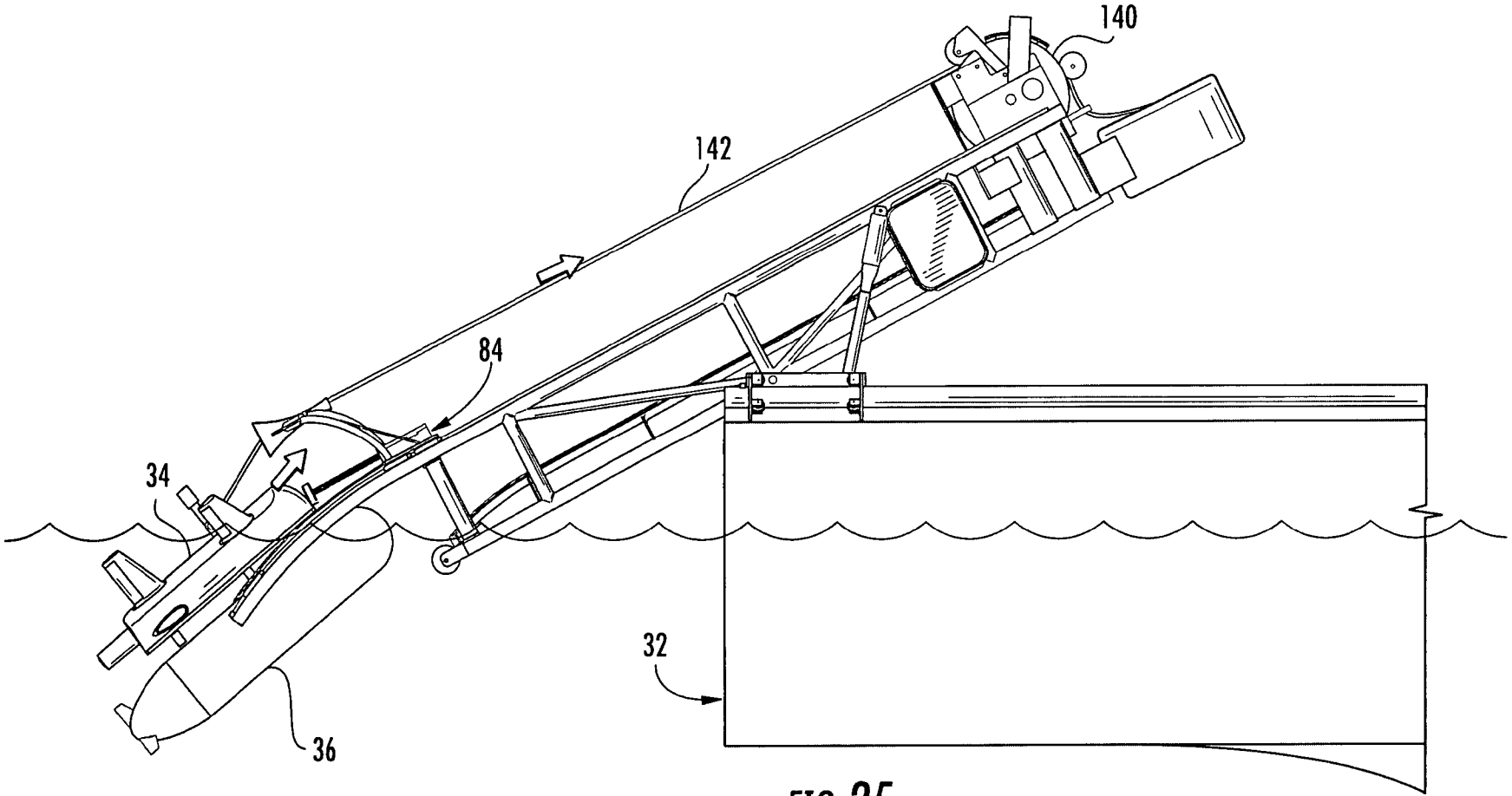

Referring to FIG. 25, initially, the locked guide latch 116 (FIG. 11) locks the guide vehicle 84 in its rearward position while the winch 140 pulls the intercepting vehicle 34 so that the intercepting vehicle slides forwardly and upwardly onto and at least partially across the upper platform 94 of the guide vehicle. As may be understood with reference to FIG. 12, the triggering bar 126 extends a predetermined distance rearward of the bulkhead 98 so that, as soon as the intercepting vehicle 34 has been pulled sufficiently far forwardly upon the upper platform 94, the front end of the intercepting vehicle 34 engages the ram 120 to unlock the guide latch 116, so that the guide vehicle 84 may travel forward with, and carry, the intercepting vehicle. That is, the guide latch 116 is automatically unlocked when the guide vehicle 84 is proximate the rear end of the upper stand 68, in response to the intercepting vehicle 34 sufficiently engaging the ram 120 to sufficiently overcome the force of the compression spring 130.

Alternatively, latching mechanism 119 may be manually actuated at the appropriate times. More specifically, the guide latch 116 may be manually unlocked at the appropriate time by having a rope (not shown), or the like, attached to the front end of triggering bar 126, or attached to an appropriate part of the linkage 122, and someone on the boat 32 pulling the rope at the appropriate time. That is, the ram 120, or at least the portions of it that are for engaging the intercepting vehicle 34, may be omitted.

Figure 26:
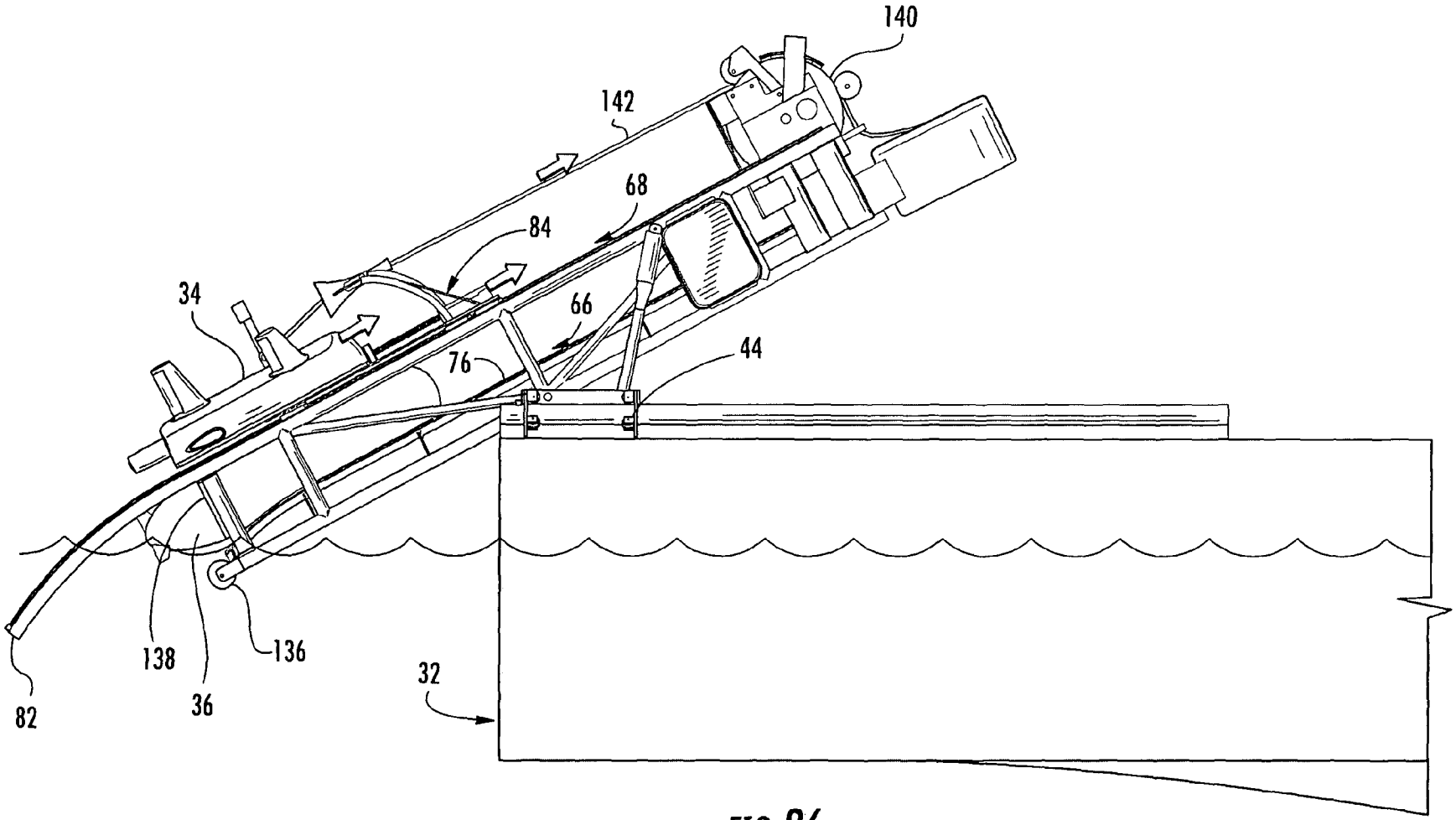

Referring to FIG. 26, after the guide latch 116 is unlocked and while the tow line 142 continues to be reeled in by the winch 140, the guide vehicle 84 is pulled forwardly and upwardly along the upper rails 82, substantially without the intercepting vehicle 34 sliding rearwardly relative to the guide vehicle. The guide rollers 136, 138 (FIGS. 5 and 13A) guide the retrievable vehicle 36 onto the lower stand 66, so that the retrievable vehicle slides forwardly and upwardly along lower platform 76. Since the intercepting vehicle 34 and the retrievable vehicle 36 are fixedly connected to one another by way of the docking latch of the intercepting vehicle being latched to the docking pole 172 of the retrievable vehicle, and the guide vehicle 84 is at least partially positioned between the vehicles 34, 36, the guide vehicle serves to guide both of the vehicles 34, 36 along their respective stands 66, 68.

The winch 140 is typically operated to reel in the tow line 142 until the guide vehicle 84 and the retrievable vehicle 34 are pulled forward of the downwardly curved portion of the upper rails 82, and a majority of the retrievable vehicle 36 is pulled forward of the downwardly curved portion of the lower platform 76. The reeling in operation of the winch 140 is typically ceased before the guide vehicle 84 or retrievable vehicle 36 bump into components at the forward end of the rack-like frame 60. For example, the operation of the winch 140 may be automatically ceased in response to the sensor 92 (FIG. 10) detecting the presence of the respective carrier 88 (FIG. 8), or the like.

Figure 27:
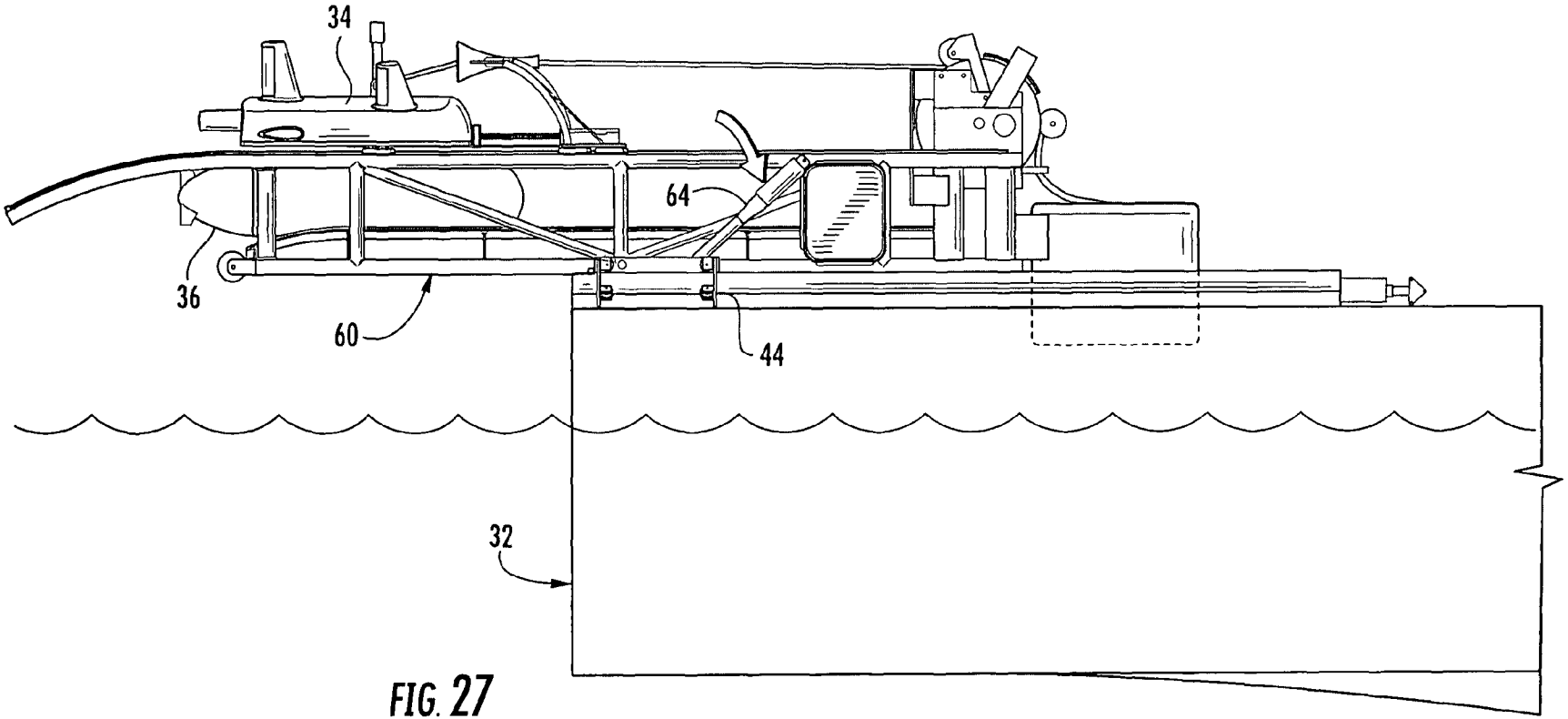
Figure 28:
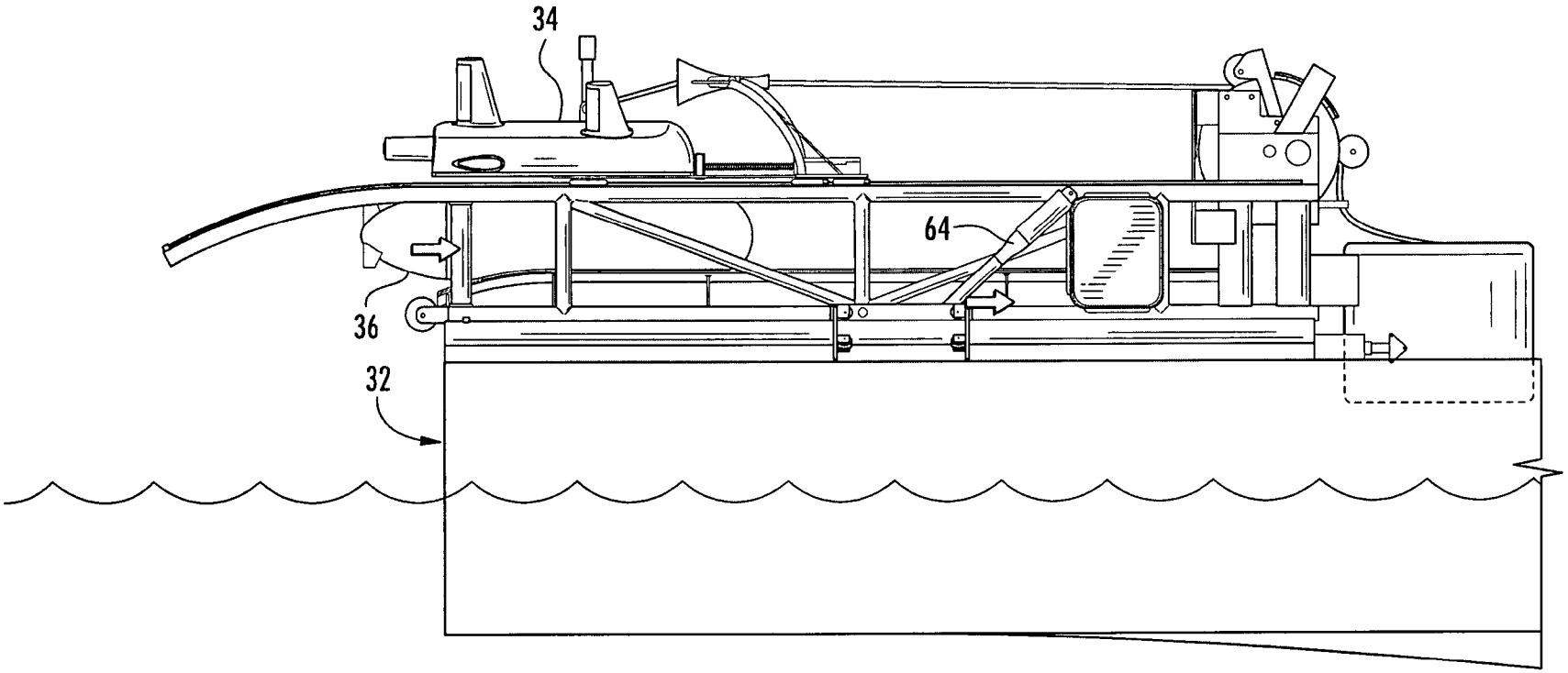

Then, the rack-like frame 60 is pivoted to its stowed position by actuation the frame actuators 64, as shown in FIG. 27. Then, the carriage actuators 58 (FIGS. 1, 3 and 7) are actuated to cause the carriage 44 and frame 60 to move (e.g., translate) forwardly and return the frame to its stowed position, as shown in FIG. 28.

Although cabling and/or tubing is not shown in the drawings as extending to the actuators 58, 64, motors 143, 161 and controller 146, those of ordinary skill will understand how to supply power and control signals for carrying out the above-discussed operations. For example, the actuators 58, 64, motors 143, 161 and controller 146 may be operated using standard manually operated user interface devices (e.g., manual control switches). More specifically, the actuators 58, 64, motors 143, 161 and controller 146 may optionally be operated at least partially through the use of a controller, such as a computer having a user interface for receiving operating instructions from a human operator.

The LARS 30 may be adapted to be used in a variety of different applications. For example, the lower stand 66 may be omitted or not used, such as when the upper stand 68 (which may be adapted (e.g., shaped) to "cradle" a variety of differently shaped vehicles) is used for launching and releasing a tow-body, for example but not limited to a powered tow-body, that is not for intercepting another vehicle. For example, the upper stand 68, guide vehicle 84, and/or any components thereof may be in the form of another type of device (e.g., "cradling" device) adapted for receiving differently configured water vehicles.

The LARS 30 of this disclosure seeks to be a robust system that may be used in a wide variety of situations, such as in heavy and/or difficult sea states (e.g., high wind, heave and/or surge conditions). In some situations, lest robustness may be desired or required, such that some features or aspects of the LARS 30 may be omitted and/or modified accordingly. That is and in accordance with one aspect of this disclosure, an alternative LARS (e.g., a less robust LARS) is like the LARS 30 of the exemplary embodiment, except, for example, that one or more features of the LARS 30 may be omitted or modified (e.g., minimized).

It will be understood by those skilled in the art that while the present disclosure has been discussed above with reference to exemplary embodiments, various additions, modifications and changes can be made thereto without departing from the spirit and scope of the invention as set forth in the claims.

What is claimed is:

1. An apparatus for launching and recovering at least one water vehicle, the apparatus comprising:

a base;

a frame supported by the base and including an elongate stand for supporting the water vehicle, wherein the stand has opposite front and rear ends that are spaced apart from one another in a longitudinal direction, and the frame is mounted for being moved relative to the base between a stowed position and a deployed position, so that the rear end of the stand is at a lower elevation in the deployed position than in the stowed position;

a guide carried by the frame and adapted for being moved back and forth along the stand in the longitudinal direction, for mechanically guiding the water vehicle along the stand in the longitudinal direction; and a winch for reeling in and unreeling a flexible tensile member that is attached to the water vehicle, wherein a first length of the flexible tensile member is more rigid, on a per unit length basis, than a second length of the flexible tensile member;

the guide comprises a guide passageway through which the flexible tensile member extends so that the first length is positioned between the water vehicle and the second length; and the first length and the guide passageway are cooperative for mechanically guiding the water vehicle along the stand in the longitudinal direction.

2. The apparatus according to claim 1, wherein:

the base comprises elongate, side-by-side rails that extend in the longitudinal direction;

the stand comprises elongate, side-by-side rails that extend in the longitudinal direction; and the rails of the stand are positioned above, and substantially parallel to, the rails of the base.

3. An apparatus for launching and recovering at least one water vehicle, the apparatus comprising:

a base;

a frame supported by the base and including an elongate stand for supporting the water vehicle, wherein the stand has opposite front and rear ends that are spaced apart from one another in a longitudinal direction, and the frame is mounted for being moved relative to the base between a stowed position and a deployed position, so that the rear end of the stand is at a lower elevation in the deployed position than in the stowed position; and a guide carried by the frame and adapted for being moved back and forth along the stand in the longitudinal direction, for mechanically guiding the water vehicle along the stand in the longitudinal direction, wherein the stand is a first stand, the frame includes an elongate second stand for supporting a second water vehicle, the second stand has opposite front and rear ends that are spaced apart from one another in the longitudinal direction, and the second stand moves with the first stand so that the rear end of the second stand is at a lower elevation in the deployed position than in the stowed position.

4. The apparatus according to claim 3, further comprising a winch for reeling in and unreeling a flexible tensile member that is attached to the water vehicle, wherein:

a first length of the flexible tensile member is more rigid, on a per unit length basis, than a second length of the flexible tensile member;

the guide comprises a guide passageway through which the flexible tensile member extends so that the first length is positioned between the water vehicle and the second length; and the first length and the guide passageway are cooperative for mechanically guiding the water vehicle along the stand in the longitudinal direction.

5. An apparatus for launching and recovering at least one water vehicle, the apparatus comprising:

a base;

a frame supported by the base and including an elongate stand for supporting the water vehicle, wherein the stand has opposite front and rear ends that are spaced apart from one another in a longitudinal direction, and the frame is mounted for being moved relative to the base between a stowed position and a deployed position, so that the rear end of the stand is at a lower elevation in the deployed position than in the stowed position;

a guide carried by the frame and adapted for being moved back and forth along the stand in the longitudinal direction, for mechanically guiding the water vehicle along the stand in the longitudinal direction; and a carriage positioned between the base and the frame, wherein the carriage is movably mounted to the base for being moved along the base between rearward and forward positions, and the frame is mounted to the carriage for moving with the carriage between the rearward and forward positions, and being pivoted relative to the carriage to move the rear end of the stand between the lower elevation and an upper elevation.

6. The apparatus according to claim 5, further comprising a boat having a deck, wherein the base is mounted to the deck of the boat.

7. The apparatus according to claim 6, wherein in the stowed position, the stand:

does not extend below the deck, extends substantially horizontally, and is substantially parallel to the deck.

8. The apparatus according to claim 6, wherein:

the deck has opposite front and rear ends that are spaced apart from one another in the longitudinal direction; and in the deployed position the stand extends obliquely to the deck the rear end of the stand is positioned rearwardly of the rear end of the deck, and the rear end of the stand is positioned below the deck.

9. The apparatus according to claim 5, further comprising:

a flexible tensile member for being attached to the water vehicle; and a winch for reeling in and unreeling the flexible tensile member, wherein the guide is a guide vehicle, and the guide vehicle includes a guide apparatus for mechanically guiding the flexible tensile member between the winch and the water vehicle.

10. An apparatus for launching and recovering at least one water vehicle, the apparatus comprising:

a base;

a frame supported by the base and including an elongate stand for supporting the water vehicle, wherein the stand has opposite front and rear ends that are spaced apart from one another in a longitudinal direction, and the frame is mounted for being moved relative to the base between a stowed position and a deployed position, so that the rear end of the stand is at a lower elevation in the deployed position than in the stowed position;

a guide carried by the frame and adapted for being moved back and forth along the stand in the longitudinal direction, for mechanically guiding the water vehicle along the stand in the longitudinal direction; and a latch for releasably securing the guide at the rear end of the stand, the latch comprising a first portion of the latch mounted to the frame, and a second portion of the latch mounted to the guide for moving back and forth along the stand in the longitudinal direction with the guide, wherein the first and second portions of the latch are cooperative for releasably securing the guide proximate the rear end of the stand.

11. The apparatus according to claim 10, further comprising an actuator for opening and closing the latch, wherein the actuator is operative for:

automatically closing the latch when the guide moves to proximate the rear end of the stand, so that the latch restricts forward movement of the guide along the stand; and automatically opening the latch in response to the water vehicle engaging the actuator in a predetermined manner, so that the latch no longer restricts forward movement of the guide along the stand.

12. The apparatus according to claim 11, wherein:

the actuator includes a triggering bar that is mounted to the guide for moving back and forth relative to the guide in the longitudinal direction, wherein the bar is rearwardly biased and is for being moved forwardly in response to being engaged by the water vehicle, and a movable link that is operatively connected to the bar for laterally reciprocating in response to the triggering bar moving back and forth relative to the guide in the longitudinal direction;

the second portion of the latch comprises a bolt mounted to the link for laterally reciprocating with the link; and the first portion of the latch includes a receptacle for receiving the bolt when the guide is proximate the rear end of the stand and the bolt is laterally outward.

13. An apparatus for launching and recovering at least one water vehicle, the apparatus comprising:

a base;

a frame supported by the base and including an elongate stand for supporting the water vehicle, wherein the stand has opposite front and rear ends that are spaced apart from one another in a longitudinal direction, and the frame is mounted for being moved relative to the base between a stowed position and a deployed position, so that the rear end of the stand is at a lower elevation in the deployed position than in the stowed position;

a guide carried by the frame and adapted for being moved back and forth along the stand in the longitudinal direction, for mechanically guiding the water vehicle along the stand in the longitudinal direction;

a flexible tensile member for being attached to the water vehicle; and a winch for reeling in and unreeling the flexible tensile member, wherein the winch is mounted to the frame, the guide is a guide vehicle, the guide vehicle includes a guide apparatus for mechanically guiding the flexible tensile member between the winch and the water vehicle, and the guide apparatus is positioned rearwardly from the winch so that the flexible tensile member extends rearwardly from the winch to the guide apparatus.

14. An apparatus for launching and recovering at least one water vehicle, the apparatus comprising:

a base;

a frame supported by the base and including an elongate stand for supporting the water vehicle, wherein the stand has opposite front and rear ends that are spaced apart from one another in a longitudinal direction, and the frame is mounted for being moved relative to the base between a stowed position and a deployed position, so that the rear end of the stand is at a lower elevation in the deployed position than in the stowed position;

a guide carried by the frame and adapted for being moved back and forth along the stand in the longitudinal direction, for mechanically guiding the water vehicle along the stand in the longitudinal direction;

a flexible tensile member for being attached to the water vehicle; and a winch for reeling in and unreeling the flexible tensile member, wherein the guide is a guide vehicle, the guide vehicle includes a guide apparatus for mechanically guiding the flexible tensile member between the winch and the water vehicle, carriers mounted to and supporting an upper support, and a bulkhead mounted to and extending above the upper support, the guide apparatus is mounted to the bulkhead above the upper support, and the carriers respectively are operatively connected between the guide vehicle and the stand for travel along the stand for allowing the guide vehicle to be moved back and forth along the stand in the longitudinal direction, for mechanically guiding the water vehicle along the stand in the longitudinal direction.

15. The apparatus according to claim 14, wherein the upper support comprises a platform having a slot that extends to a rear edge of the platform.

16. An apparatus for launching and recovering at least one water vehicle, the apparatus comprising:

a base;

a frame supported by the base and including an elongate stand for supporting the water vehicle, wherein the stand has opposite front and rear ends that are spaced apart from one another in a longitudinal direction, and the frame is mounted for being moved relative to the base between a stowed position and a deployed position, so that the rear end of the stand is at a lower elevation in the deployed position than in the stowed position;

a guide carried by the frame and adapted for being moved back and forth along the stand in the longitudinal direction, for mechanically guiding the water vehicle along the stand in the longitudinal direction;

a flexible tensile member including opposite first and second ends, wherein the first end is for being attached to the water vehicle, and the flexible tensile member including first and second intermediate sections positioned between the first and second ends of the tensile member, wherein the first intermediate section of the tensile member is elongate, and the first intermediate section of the tensile member is closer to the first end of the tensile member than to the second end of the tensile member, and the second intermediate section of the tensile member is elongate, and the second intermediate section of the tensile member is closer to the second end of the tensile member than to the first end of the tensile member; and a winch for reeling in and unreeling the flexible tensile member, wherein the winch includes a rotatable drum that the first intermediate section of the tensile member extends around, and each of the first end of the tensile member, the second end of the tensile member and the second intermediate section of the tensile member are distant from the winch.

17. The apparatus according to claim 16, wherein:

the winch is mounted to the frame for moving with the frame, and the second intermediate section of the tensile member is positioned in a receptacle.

18. An apparatus for launching and recovering water vehicles, the apparatus comprising:

a base; and a rack supported by the base and including a plurality of stands for respectively supporting the water vehicles, wherein each stand is elongate and has opposite front and rear ends that are spaced apart from one another in a longitudinal direction, the rack is mounted for being moved relative to the base between a stowed position and a deployed position, so that for each stand, at least the rear end of the stand is at a lower elevation in the deployed position than in the stowed position, the plurality of stands includes a first stand and a second stand, the second stand is positioned beneath the first stand, and the second stand is substantially parallel to the first stand.

19. The apparatus according to claim 18, further comprising a guide carried by the rack and adapted for being moved back and forth along the rack in the longitudinal direction, for substantially simultaneously mechanically guiding the water vehicles along the respective stands in the longitudinal direction.

20. A combination comprising:

water vehicles; and an apparatus for launching and recovering the water vehicles, the apparatus comprising a base, and a rack supported by the base and including a plurality of stands for respectively supporting the water vehicles, wherein each stand is elongate has opposite front and rear ends that are spaced apart from one another in a longitudinal direction, the rack is mounted for being moved relative to the base between a stowed position and a deployed position, so that for each stand, at least the rear end of the stand is at a lower elevation in the deployed position than in the stowed position, the water vehicles comprise a first water vehicle and a second water vehicle, the plurality of stands comprises a first stand and a second stand, the first water vehicle is adjacent to the second water vehicle, the first water vehicle is latched to the second water vehicle, the first water vehicle is supported by the first stand of the rack, the second water vehicle is supported by the second stand of the rack, and the first stand of the rack is adjacent to the second stand of the rack.

21. The combination according to claim 20, wherein:

the second stand of the rack is positioned beneath the first stand; and the second stand of the rack is substantially parallel to the first stand.

22. The combination according to claim 20, in wherein:

the second stand of the rack is beneath the first stand of the rack; and the second water vehicle is beneath the first water vehicle.

23. A method of at least recovering a first water vehicle to a second water vehicle while the second water vehicle is floating in a body of water, comprising:

moving a stand on the second water vehicle from a stowed position to a deployed position, wherein the stand is closer to the body of water in the deployed position than in the stowed position; and causing relative movement between the first and second water vehicles while the stand is in the deployed position, comprising causing the first and second water vehicles to become closer to one another, causing the first water vehicle to become proximate to the stand, and mechanically guiding the first water vehicle along the stand so that the first water vehicle is supported by the stand, wherein the mechanically guiding comprises pulling the first water vehicle onto and along the stand with a flexible tensile member that extends through a guide passageway, including:

pulling a first length of the flexible tensile member through the guide passageway, and then pulling a second length of the flexible tensile member through the guide passageway, wherein the second length of the flexible tensile member is more rigid, on a per unit length basis, than the first length of the flexible tensile member.

24. The method according to claim 23, further comprising moving the stand on the second water vehicle from the deployed position to the stowed position, while the first water vehicle is supported by the stand.

25. The method according to claim 23, wherein the mechanically guiding of the first water vehicle along the stand comprises mechanically guiding the first water vehicle into an enclosure while the stand is in the deployed position, so that the first water vehicle is at least partially enclosed by the enclosure while:

the stand is in the deployed position, and the first water vehicle is supported by the stand.

26. The method according to claim 23, wherein the moving of the stand to the deployed position comprises inclining the stand so that simultaneously:

a lower end of the stand is proximate the body of water; and an upper end of the stand is positioned above the body of water, and positioned over a deck of the second water vehicle.

27. The method according to claim 26, wherein the lower end of the stand being proximate the body of water comprises the lower end of the stand being in the body of water.

28. The method according to claim 23, wherein:

the moving of the stand to the deployed position comprises placing the stand in an inclined configuration; and the pulling of the first water vehicle comprises pulling the first water vehicle upwardly along the inclined stand, so that the first water vehicle is supported by the inclined stand.

29. The method according to claim 28, wherein the pulling of the first water vehicle comprises reeling in a flexible tensile member with a winch.

30. A method of at least recovering a first water vehicle to a second water vehicle while the second water vehicle is floating in a body of water, comprising:

moving a stand on the second water vehicle from a stowed position to a deployed position, wherein the stand is closer to the body of water in the deployed position than in the stowed position, and the moving of the stand to the deployed position comprises placing the stand in an inclined configuration;

moving a guide vehicle downwardly along the inclined stand; and causing relative movement between the first and second water vehicles while the stand is in the deployed position, comprising causing the first and second water vehicles to become closer to one another, causing the first water vehicle to become proximate to the stand, and mechanically guiding the first water vehicle along the stand so that the first water vehicle is supported by the stand, wherein the mechanically guiding of the first water vehicle along the stand comprises using the guide vehicle to mechanically guide the first water vehicle upwardly along the stand so that the first water vehicle is supported by both the guide vehicle and the stand.

31. The method according to claim 30, wherein the moving of the guide vehicle downwardly along the inclined stand comprises:

allowing gravity to draw the guide vehicle downwardly along the inclined stand in response to the stand being inclined; and then restricting travel of the guide vehicle so that the guide vehicle remains upon the inclined stand and is positioned proximate a lower end of the inclined stand.

32. A method of at least recovering a first water vehicle to a second water vehicle while the second water vehicle is floating in a body of water, comprising:

moving a stand on the second water vehicle from a stowed position to a deployed position, wherein the stand is closer to the body of water in the deployed position than in the stowed position, and the moving of the stand to the deployed position comprises placing the stand in an inclined configuration; and causing relative movement between the first and second water vehicles while the stand is in the deployed position, comprising causing the first and second water vehicles to become closer to one another, causing the first water vehicle to become proximate to the stand, and mechanically guiding the first water vehicle along the stand so that the first water vehicle is supported by the stand, comprising pulling the first water vehicle upwardly along the inclined stand, so that the first water vehicle is supported by the inclined stand, wherein the pulling of the first water vehicle upwardly along the inclined stand comprises:

pulling the first water vehicle onto a guide vehicle, and pulling the first water vehicle while the first water vehicle is upon the guide vehicle, so that the first water vehicle entrains the guide vehicle, and the guide vehicle carries the first water vehicle upwardly along the inclined stand while the first water vehicle is upon and entraining the guide vehicle.

33. The method according to claim 32, further comprising launching the first water vehicle, comprising allowing gravity to draw the guide vehicle and the first water vehicle downwardly along the inclined stand while the first water vehicle is upon the guide vehicle; then restricting travel of the guide vehicle so that the first water vehicle is released from the guide vehicle.

34. A method of at least recovering first and second water vehicles from a body of water to a rack while the rack is supported by a water vehicle floating in the body of water, comprising:

substantially simultaneously placing the first and second water vehicles on the rack while the first water vehicle is adjacent to and latched to the second water vehicle; and supporting first and second water vehicles on the rack while the first water vehicle is latched to the second water vehicle, comprising simultaneously the first water vehicle being adjacent to the second water vehicle, the first water vehicle being latched to the second water vehicle, the first water vehicle being supported by a first stand of the rack, the second water vehicle being supported by a second stand of the rack, and the first stand of the rack being adjacent to the second stand of the rack.

35. The method according to claim 34, comprising latching the first water vehicle to the second water vehicle prior to the placing the first and second water vehicles on the rack.

36. The method according to claim 34, wherein the placing of the first and second water vehicles on the rack comprises substantially simultaneously moving the first and second water vehicles respectively onto the first and second stands while simultaneously:

the first water vehicle is adjacent to the second water vehicle, the first water vehicle is latched to the second water vehicle, and the first stand of the rack is adjacent to the second stand of the rack.

37. The method according to claim 36, wherein the moving of the first and second water vehicles comprises pulling the first water vehicle onto the first rack while simultaneously:

the first water vehicle is adjacent to the second water vehicle, the first water vehicle is latched to the second water vehicle, the first stand of the rack is adjacent to the second stand of the rack.

38. The method according to claim 34, comprising:

transporting the rack on the water vehicle floating in the body of water during the supporting of the first and second water vehicles on the rack; and launching the first and second water vehicles into the body of water from the rack while the rack is supported by the water vehicle floating in the body of water, the launching being carried out while simultaneously the first water vehicle is adjacent to the second water vehicle, the first water vehicle is latched to the second water vehicle, and the first stand of the rack is adjacent to the second stand of the rack.

39. The method according to claim 38, comprising unlatching the first water vehicle from the second water vehicle while the first and second water vehicles are in the body of water, after the launching of the first and second water vehicles.

* * * * *